US009909733B2

(12) United States Patent
Kanayama et al.

(10) Patent No.: US 9,909,733 B2
(45) Date of Patent: Mar. 6, 2018

(54) LIGHTING APPARATUS AND AUTOMOBILE INCLUDING THE SAME

(71) Applicant: PANASONIC INTELLECTUAL PROPERTY MANAGEMENT CO., LTD., Osaka (JP)

(72) Inventors: Yoshihiko Kanayama, Hyogo (JP); Hiro Aoki, Osaka (JP); Makoto Kai, Kyoto (JP); Tomoyuki Ogata, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 190 days.

(21) Appl. No.: 14/706,116

(22) Filed: May 7, 2015

(65) Prior Publication Data

US 2015/0323147 A1 Nov. 12, 2015

(30) Foreign Application Priority Data

May 9, 2014 (JP) ..... 2014-098144
May 9, 2014 (JP) ..... 2014-098146
May 9, 2014 (JP) ..... 2014-098158

(51) Int. Cl.
*F21S 8/10* (2006.01)
*F21V 5/00* (2018.01)
(Continued)

(52) U.S. Cl.
CPC ..... *F21S 48/328* (2013.01); *F21S 48/1104* (2013.01); *F21S 48/1154* (2013.01);
(Continued)

(58) Field of Classification Search
CPC . B60Q 1/0058; B60Q 1/0041; F21S 48/1104; F21S 48/115; F21S 48/1195;
(Continued)

(56) References Cited

U.S. PATENT DOCUMENTS 7,156,544 B2 1/2007 Ishida
8,154,864 B1 * 4/2012 Nearman ..... G09F 9/33 165/104.33
(Continued)

FOREIGN PATENT DOCUMENTS

JP 2005-108554 4/2005
JP 2006-331817 A 12/2006
(Continued)

OTHER PUBLICATIONS

U.S. Appl. No. 14/688,194 to Kanayama et al., filed Apr. 16, 2015.
(Continued)

*Primary Examiner* — Jong-Suk (James) Lee
*Assistant Examiner* — Zheng Song
(74) *Attorney, Agent, or Firm* — Greenblum & Bernstein, P.L.C.

(57) ABSTRACT

A lighting apparatus for vehicle use that projects light forward includes: a base; a first light emitting device disposed on the base; a second light emitting device disposed on the base; a first lens body disposed in front of the first light emitting device; a second lens body disposed in front of the second light emitting device; and a light restrictor adjacent to the first lens body, the light restrictor restricting light emitted by the second light emitting device from entering the first lens body.

17 Claims, 28 Drawing Sheets

(51) Int. Cl.

| | |
|---|---|
| ***F21V 29/70*** | (2015.01) |
| ***F21V 11/16*** | (2006.01) |
| ***F21V 7/00*** | (2006.01) |
| *F21V 29/71* | (2015.01) |
| *F21Y 115/10* | (2016.01) |

(52) U.S. Cl.
CPC ..... *F21S 48/1159* (2013.01); *F21S 48/1208* (2013.01); *F21S 48/1216* (2013.01); *F21S 48/1241* (2013.01); *F21S 48/1258* (2013.01); *F21S 48/1329* (2013.01); *F21S 48/142* (2013.01); *F21S 48/145* (2013.01); *F21S 48/1747* (2013.01); *F21S 48/321* (2013.01); *F21V 5/007* (2013.01); *F21V 7/0066* (2013.01); *F21V 11/16* (2013.01); *F21V 29/70* (2015.01); *F21S 48/32* (2013.01); *F21V 29/71* (2015.01); *F21V 29/713* (2015.01); *F21Y 2115/10* (2016.08)

(58) Field of Classification Search
CPC ..... F21S 48/1216; F21S 48/1208; F21S 48/1225; F21S 48/1241; F21S 48/1258; F21S 48/142; F21S 48/1747; F21S 48/321; F21V 5/007
See application file for complete search history.

(56) References Cited

U.S. PATENT DOCUMENTS

| | | | | |
|---|---|---|---|---|
| 2004/0202007 | A1* | 10/2004 | Yagi | F21S 48/1159 362/545 |
| 2005/0068787 | A1 | 3/2005 | Ishida | |
| 2006/0120094 | A1* | 6/2006 | Tsukamoto | F21S 48/1159 362/518 |
| 2009/0097268 | A1* | 4/2009 | Mochizuki | F21S 48/1159 362/538 |
| 2009/0290372 | A1* | 11/2009 | Kotajima | F21S 48/1159 362/539 |
| 2010/0020563 | A1* | 1/2010 | Ito | F21S 48/1154 362/547 |
| 2010/0208483 | A1* | 8/2010 | Hamashima | B60Q 1/068 362/520 |
| 2011/0080092 | A1 | 4/2011 | Matsumoto et al. | |
| 2011/0199776 | A1* | 8/2011 | Takahashi | B60Q 1/0041 362/538 |
| 2012/0008335 | A1 | 1/2012 | Yamamoto | |
| 2012/0134167 | A1* | 5/2012 | Huang | B60Q 1/0041 362/519 |
| 2012/0294026 | A1 | 11/2012 | Matsumoto et al. | |
| 2013/0010488 | A1* | 1/2013 | Koizumi | F21S 48/1154 362/517 |
| 2013/0083553 | A1* | 4/2013 | Sekiguchi | B60Q 1/0041 362/517 |
| 2013/0107564 | A1* | 5/2013 | Yatsuda | F21S 48/32 362/543 |
| 2013/0327964 | A1* | 12/2013 | Otsuka | F21V 5/04 250/504 R |
| 2014/0009951 | A1* | 1/2014 | Monma | F21S 48/00 362/509 |
| 2014/0146555 | A1* | 5/2014 | Choi | F21S 48/1104 362/512 |
| 2014/0321147 | A1* | 10/2014 | Todaka | F21S 48/12 362/516 |

FOREIGN PATENT DOCUMENTS

| | | | | |
|---|---|---|---|---|
| JP | 200964629 | * | 3/2009 | F21V 29/00 |
| JP | 2011-081967 | A | 4/2011 | |
| JP | 2011-198719 | A | 10/2011 | |
| JP | 2012-018840 | A | 1/2012 | |
| JP | 2013-247049 | A | 12/2013 | |

OTHER PUBLICATIONS

U.S. Appl. No. 14/693,152 to Kanayama et al., filed Apr. 22, 2015.
Office Action issued in Japan Counterpart Patent Appl. No. 2014-098144, dated Nov. 21, 2017.
Office Action issued in Japan Counterpart Patent Appl. No. 2014-098146, dated Nov. 21, 2017.
Office Action issued in Japan Counterpart Patent Appl. No. 2014-098158, dated Nov. 21, 2017.

* cited by examiner

LIGHTING APPARATUS AND AUTOMOBILE INCLUDING THE SAME

CROSS REFERENCE TO RELATED APPLICATIONS

This application claims the benefit of priority of Japanese Patent Application Number 2014-098146, filed May 9, 2014, Japanese Patent Application Number 2014-098158, filed May 9, 2014, and Japanese Patent Application Number 2014-098144, filed May 9, 2014, the entire content of which is hereby incorporated by reference.

BACKGROUND OF THE INVENTION

1. Field of the Invention

The present disclosure relates to a lighting apparatus and an automobile including the lighting apparatus.

2. Description of the Related Art

Vehicles such as automobiles are equipped with headlights in the front. These headlights include a housing (chassis) and a lighting apparatus attached to the housing.

Lighting apparatuses used in vehicle headlights include, for example, a base, a low beam light emitting device and a high beam light emitting device disposed on the base, and a lens positioned in front of the low beam light emitting device and the high beam light emitting device (see Japanese Unexamined Patent Application Publication No. 2005-108554).

Examples of conventional low beam light emitting devices and high beam light emitting devices used include high intensity discharge (HID) lamps. In recent years, due to the luminous efficiency and long lifespan of light emitting diodes (LEDs), which exceed HID lamps, lighting apparatuses using LEDs as the low beam light emitting devices and high beam light emitting devices have been researched and developed.

SUMMARY OF THE INVENTION

Vehicle lighting apparatuses include two light emitting devices (light sources)—a low beam light emitting device and a high beam light emitting device. For this reason, lighting apparatuses are optically designed so that the two light emitting devices each illuminate a prescribed area only. However, light from the low beam light emitting device may leak toward the high beam, which results in light leaking outside the prescribed area to be illuminated.

An object of the present disclosure is to provide a lighting apparatus and automobile with which light leak can be reduced and lighting efficiency can be increased.

In order to achieve the aforementioned object, according to one aspect of the present disclosure, a lighting apparatus for vehicle use that projects light forward is provided. The lighting apparatus includes: a base; a first light emitting device disposed on the base; a second light emitting device disposed on the base; a first lens body disposed in front of the first light emitting device; a second lens body disposed in front of the second light emitting device; and a light restrictor adjacent to the first lens body, the light restrictor restricting light emitted by the second light emitting device from entering the first lens body.

Accordingly, light leak can be reduced and lighting efficiency can be increased.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Figure 1:
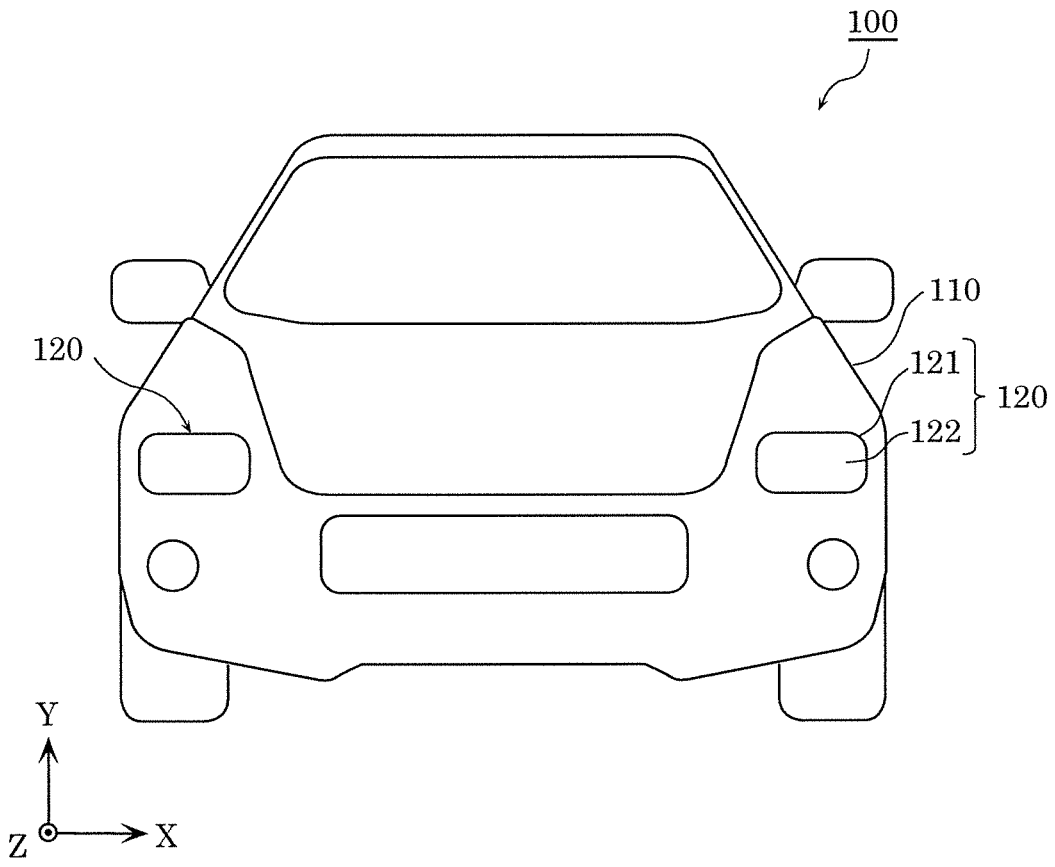
FIG. 1 is a front view of an automobile according to one example of the present invention.

Hereinafter, a lighting apparatus and automobile according to embodiments are described in detail with reference to the accompanying drawings. Note that the embodiments described below show a specific preferred example of the present disclosure. Therefore, the numerical values, shapes, materials, structural elements, arrangement and connection of the structural elements, etc., shown in the following embodiment are mere examples, and are not intended to limit the present disclosure. Consequently, among the structural elements in the following embodiments, elements not recited in any one of the independent claims which indicate the broadest concepts of the present disclosure are described as arbitrary structural elements.

Hereinafter, in this disclosure, "front" and "forward" refer to the direction in which light is emitted from the lighting apparatus (i.e., the light-emitting direction) and the light-extraction direction in which light is extracted, and "back" and "behind" refer to the direction opposite the front/forward direction. Furthermore, "front" and "forward" refer to the direction of travel when an automobile moves forward, "right" and "left" are from the perspective of the driver, "up", "upward", and "above" refer to the direction toward the ceiling of the automobile, and "down", "downward", and "below" refer to the direction opposite the up/upward/above direction. Additionally, the Z axis corresponds to the anteroposterior direction, the Y axis corresponds to the up and down (vertical) directions, and the X axis corresponds to the left and right (horizontal, lateral) directions.

It should be noted that the respective figures are schematic diagrams and are not necessarily precise illustrations. Additionally, components that are essentially the same share the same reference numerals in the respective figures, and overlapping explanations thereof are omitted or simplified.

First Embodiment

First, automobile 100 according to a first embodiment will be described with reference to FIG. 1. FIG. 1 is a front view of an automobile according to the first embodiment.

As illustrated in FIG. 1, automobile 100 is one example of a vehicle, such as a four-wheeled automobile, and includes vehicle body 110 and a pair of headlights 120 disposed on the left and right sides of the front of vehicle body 110. Automobile 100 is, for example, an automobile propelled by a gasoline engine or an automobile propelled by an electric engine.

In the first embodiment, headlights 120 are headlight assemblies used in a vehicle and include housing 121, front cover 122, and a lighting apparatus (not shown in FIG. 1) that is attached to housing 121 behind front cover 122.

Housing 121 is, for example, a metal chassis and has an opening from which light emitted from the lighting apparatus exits. Front cover 122 is a headlight cover that transmits light and covers the opening of housing 121. Housing 121 and front cover 122 are sealed together so as to keep water and dust from entering housing 121.

The lighting apparatus is disposed behind front cover 122 and attached to housing 121. The light emitted by the lighting apparatus transmits through front cover 122 and travels outward.

Lighting Apparatus

Figure 2:
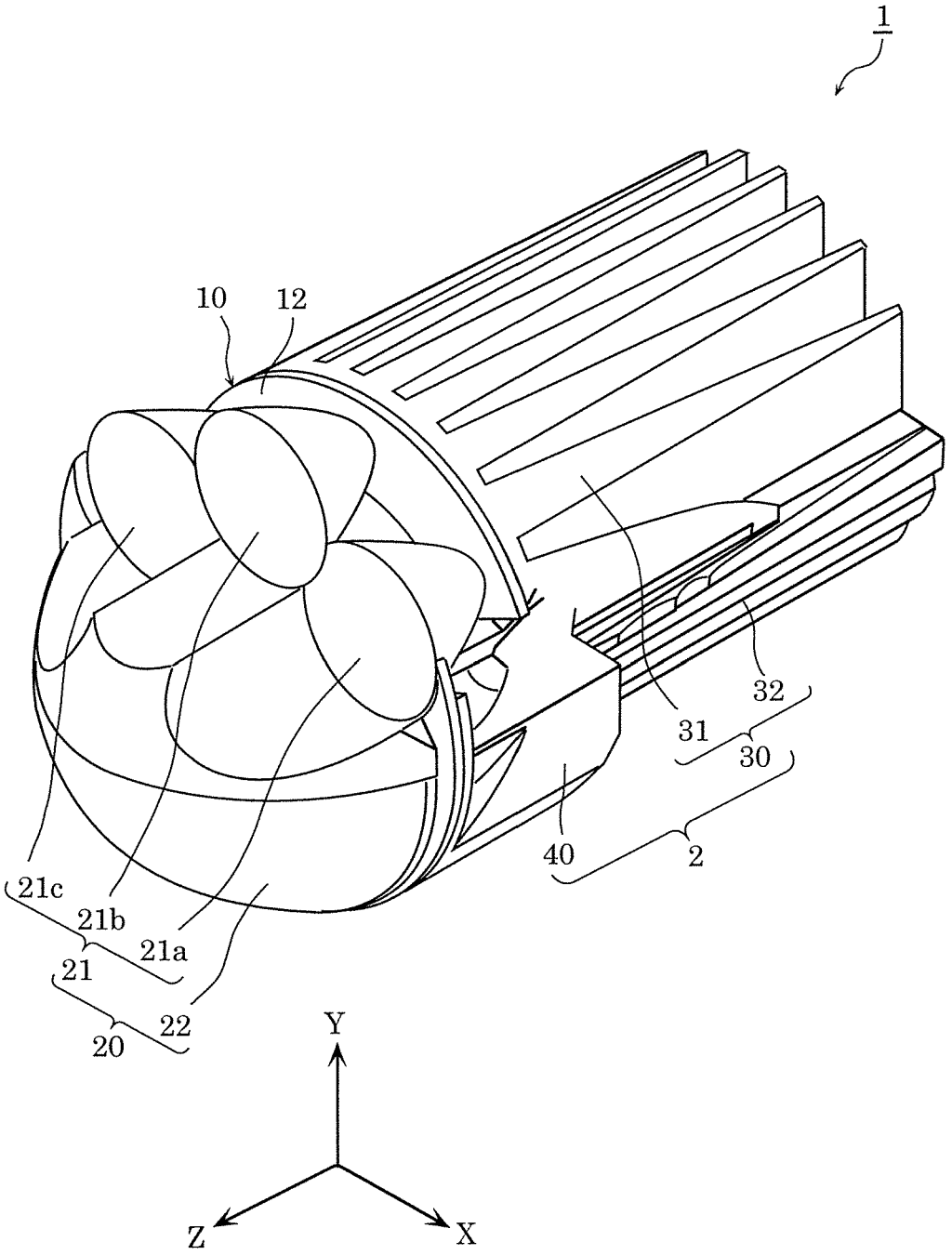
FIG. 2 is a perspective view of a lighting apparatus according to one example of the present invention.
Figure 3:
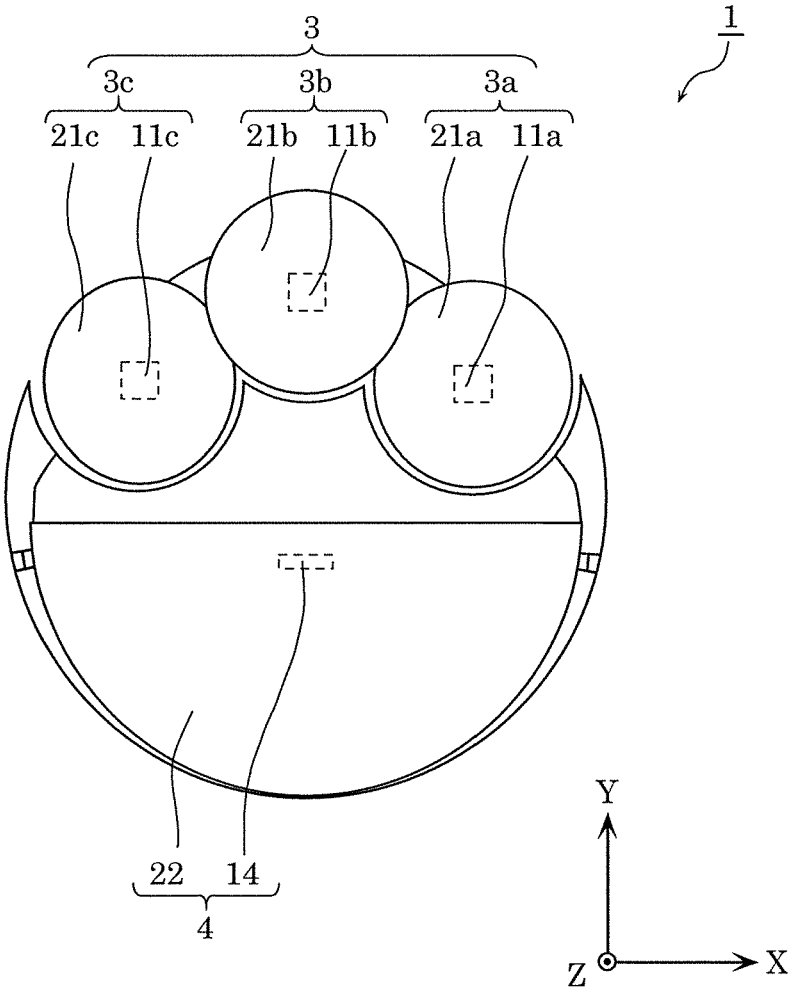
FIG. 3 is a front view of a lighting apparatus according to one example of the present invention.
Figure 4:
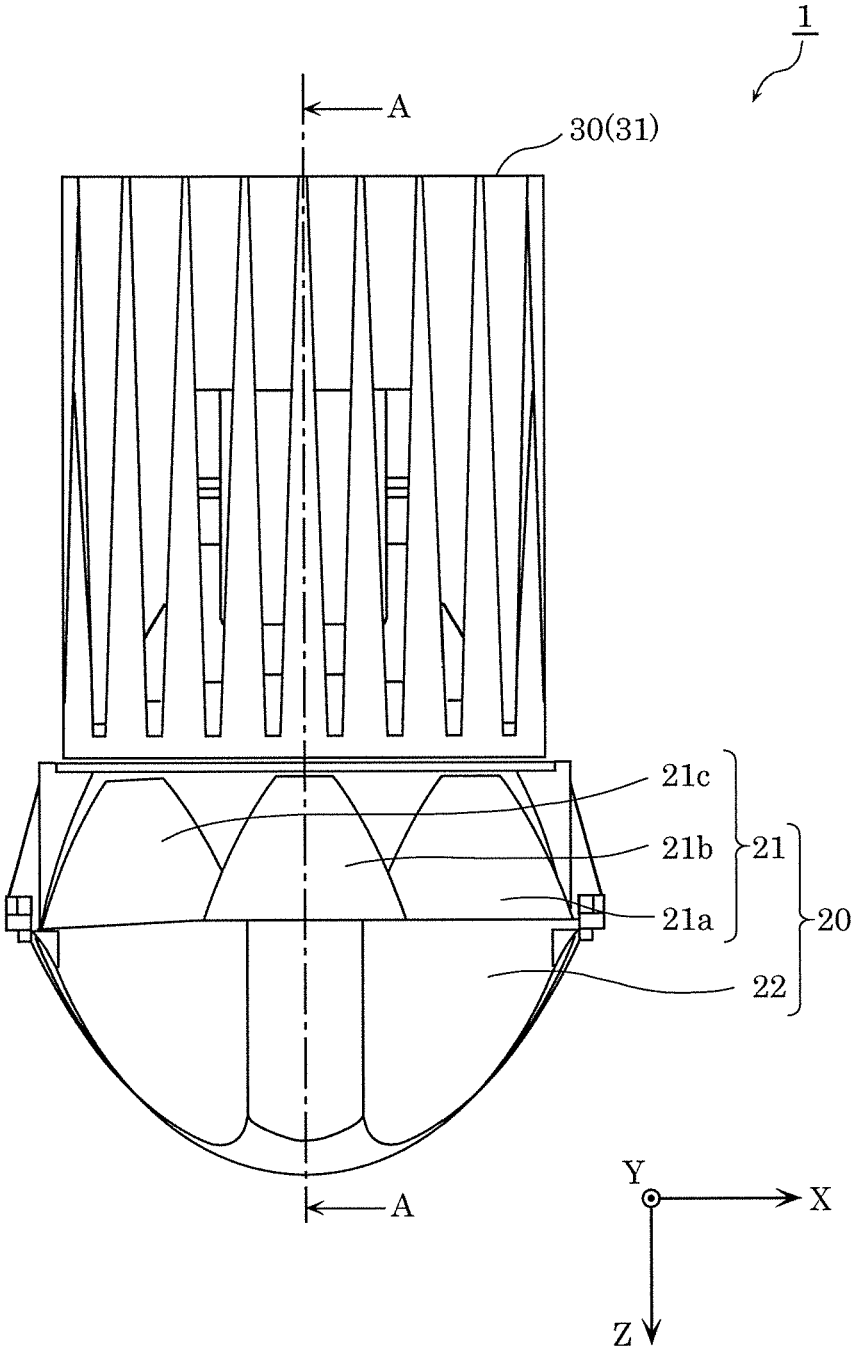
FIG. 4 is a top view of a lighting apparatus according to one example of the present invention.
Figure 5:
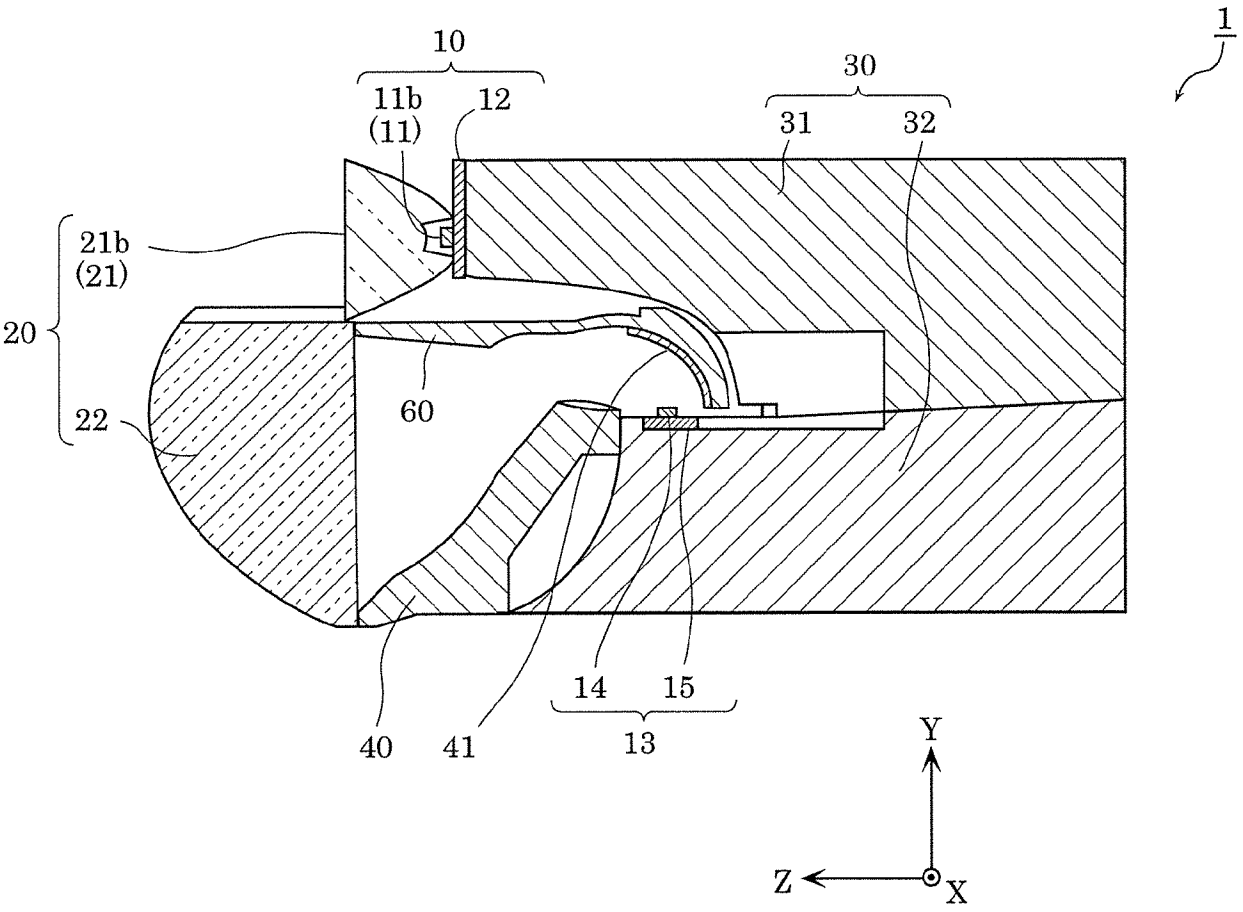
FIG. 5 is a cross sectional view of a lighting apparatus according to one example of the present invention taken at line A-A in FIG. 4.
Figure 6:
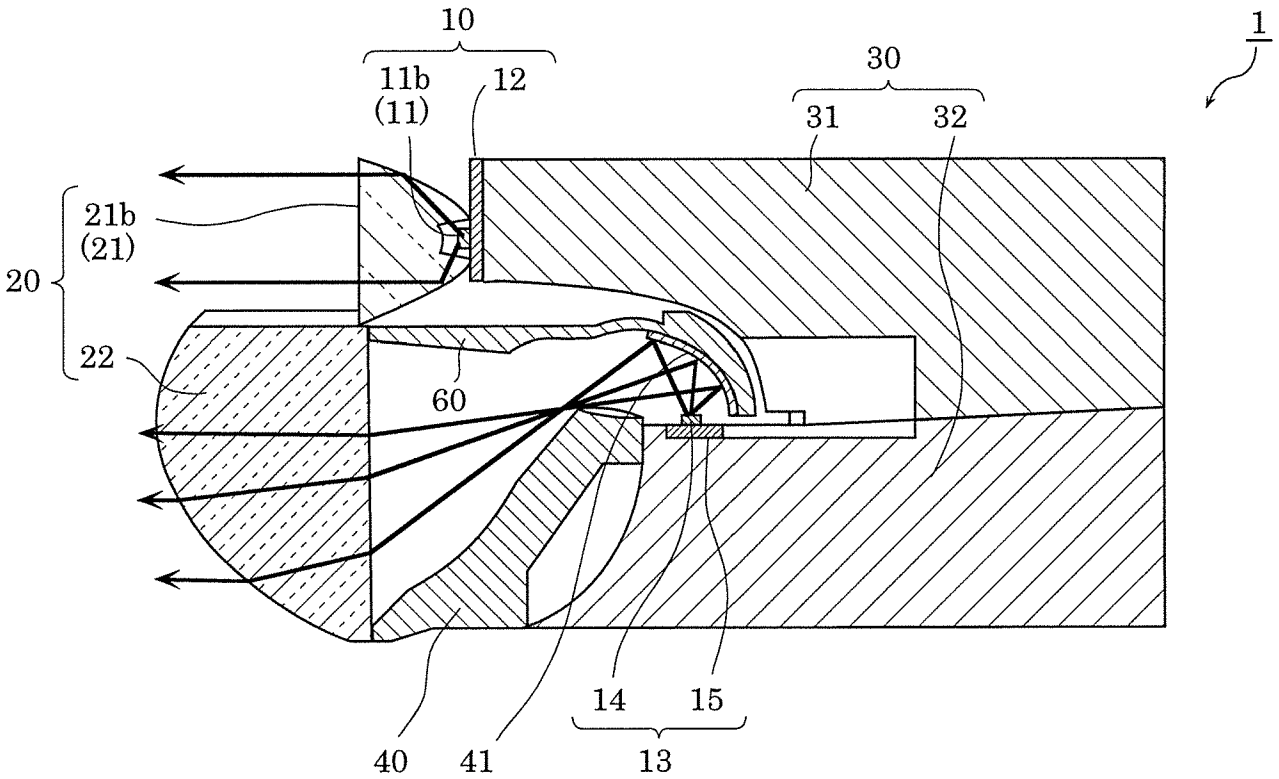
FIG. 6 is a cross sectional view of a lighting apparatus according to one example of the present invention taken at line A-A in FIG. 4, illustrating paths of light emitted when the high beams and low beams are in use.

Next, lighting apparatus 1 according to the first embodiment will be described with reference to FIG. 2 through FIG. 6. FIG. 2 is a perspective view of lighting apparatus 1 according to the first embodiment. FIG. 3 is a front view of lighting apparatus 1. FIG. 4 is a top view of lighting apparatus 1. FIG. 5 is a cross sectional view of lighting apparatus 1 taken at line A-A in FIG. 4. FIG. 6 is a cross sectional view of lighting apparatus 1 taken at line A-A in FIG. 4, and illustrates light paths of the light emitted when the high beams and the low beams are used.

Lighting apparatus 1 according to the first embodiment is a vehicle lighting apparatus used in, for example, a vehicle headlight, and projects light forward. As illustrated in FIG. 2 through FIG. 5, the main body of lighting apparatus 1 includes base 2, high beam lamp 3, low beam lamp 4, and light restrictor 60.

Base 2 includes heat sink 30 and shield 40.

More specifically, high beam lamp 3 includes first high beam lamp 3*a*, first high beam lamp 3*b*, and second high beam lamp 3*c*. Here, first high beam lamp 3*a* includes first high beam light emitting device 11*a* and first collimating lens 21*a*. First high beam lamp 3*b* includes first high beam light emitting device 11*b* and first collimating lens 21*b*. Second high beam lamp 3*c* includes second high beam light emitting device 11*c* and second collimating lens 21*c*.

Low beam lamp 4 includes low beam light emitting device 14 (also referred to as second light emitting device) and low beam lens unit 22 (also referred to as second lens body).

High beam light source module 10 and low beam light source module 13 are herein defined as follows. As illustrated in FIG. 5, high beam light source module 10 includes high beam light emitting device (first light emitting device) 11 and substrate 12 for high beam use. Low beam light source module 13 includes low beam light emitting device (second light emitting device) 14 and substrate 15 for low beam use.

Lens body 20 is herein defined as follows. As illustrated in FIG. 4, lens body 20 includes high beam lens unit 21 and low beam lens unit 22. High beam lens unit 21 includes first collimating lens 21*a*, first collimating lens 21*b*, and second collimating lens 21*c*.

As illustrated in FIG. 5, lens body 20 is disposed in front of high beam light source module 10 (high beam light emitting device 11) and low beam light source module 13

(low beam light emitting device 14). As illustrated in FIG. 4, lens body 20 includes high beam lens unit 21 (also referred to as first lens body) and low beam lens unit 22 (also referred to as second lens body). High beam lens unit 21 is configured of three collimating lenses—first collimating lens 21*a*, first collimating lens 21*b*, and second collimating lens 21*c*.

Light restrictor 60 restricts light emitted by the second light emitting device (low beam light emitting device 14) from traveling into the high beam light path. Here, light restrictor 60 restricts light emitted by the second light emitting device (low beam light emitting device 14) from entering the first lens body (high beam lens unit 21). Light restrictor 60 may diffusely reflect light emitted by the second light emitting device and, alternatively, may absorb light emitted by the second light emitting device. When light restrictor 60 is to reflect light diffusely, the surface of light restrictor 60 may be roughened instead of treated to have a mirror finish. For example, the surface of light restrictor 60 (the bottom surface in FIG. 5) may be roughened, colored white, treated to have a fine corrugated surface, or treated with a knurling process to facilitate diffuse reflection of light. When light restrictor 60 is to absorb light, a dark (such as black), light-absorbing surface may be formed. So long as light restrictor 60 is capable of reducing or eliminating light leak, the method used to achieve this is not limited to a particular method.

As illustrated in FIG. 5, heat sink 30 is configured of two heat dissipating components—first heat sink 31 thermally coupled to high beam light emitting device 11 and second heat sink 32 thermally coupled to low beam light emitting device 14.

In the first embodiment, heat sink 30 and shield 40 together form base 2, and high beam light source module 10 and low beam light source module 13 are disposed on base 2. In other words, high beam light emitting device 11 and low beam light emitting device 14 are disposed on base 2.

As illustrated in FIG. 3, high beam light source module 10 and high beam lens unit 21 together form high beam lamp 3. High beam lamp 3 is an optical system for producing a high beam having a desired light distribution pattern. More specifically, high beam lamp 3 includes first high beam lamp 3*a*, first high beam lamp 3*b*, and second high beam lamp 3*c*.

As illustrated in FIG. 3, low beam light source module 13 and low beam lens unit 22 together form low beam lamp 4. Low beam lamp 4 is an optical system for producing a low beam having a desired light distribution pattern.

Note that high beam lamp 3 and low beam lamp 4 may include other optical components.

As illustrated in FIG. 3 and FIG. 4, high beam light source module 10, low beam light source module 13, lens body 20, heat sink 30, and shield 40 are arranged so as to fit in a given circular region when viewed along the Z axis, and in the first embodiment, are arranged so as to fit in a $\phi$70 mm region.

Moreover, light restrictor 60 is adjacent to high beam lens unit 21 (i.e., below high beam lens unit 21). Light restrictor 60 is integrally formed with base 2. In other words, light restrictor 60 is integrally formed with at least one of heat sink 30 or shield 40. In the first embodiment, light restrictor 60 is exemplified as being integrally formed with shield 40.

Hereinafter, each structural element will be described in detail.

Light Source Modules

High beam light source module 10 is an LED module for producing the high beam, and is used to illuminate an area a far distance ahead. Low beam light source module 13 is an LED module for producing the low beam, and is used to illuminate the road immediately ahead.

A plurality of high beam light emitting devices 11 (first high beam light emitting device 11*a*, first high beam light emitting device 11*b*, and second high beam light emitting device 11*c*) are mounted on substrate 12 in high beam light source module 10. In the first embodiment, first high beam light emitting device 11*a*, first high beam light emitting device 11*b*, and second high beam light emitting device 11*c* are mounted so as to correspond to first collimating lens 21*a*, first collimating lens 21*b*, and second collimating lens 21*c*, respectively. Low beam light emitting device 14 is mounted on substrate 15 in low beam light source module 13.

High beam light source module 10 and low beam light source module 13 are, for example, white light sources, such as B-Y white LED light sources that use a blue LED chip and a yellow phosphor to emit white light. Alternatively, high beam light source module 10 and low beam light source module 13 may be white LED light sources that use an LED chip that emits red light, an LED chip that emits green light, and an LED chip that emits blue light to collectively emit white light.

Moreover, high beam light source module 10 and low beam light source module 13 may be surface mount device (SMD) modules, and alternatively may be chip on board (COB) modules.

When high beam light source module 10 and low beam light source module 13 are SMD modules, high beam light emitting device 11 and low beam light emitting device 14 are each an SMD LED mounted on an LED chip (bare chip) and sealed with a sealant (phosphor-containing resin) in a resin package. When high beam light source module 10 and low beam light source module 13 are COB modules, high beam light emitting device 11 and low beam light emitting device 14 are each LED chips themselves, and are directly mounted on substrate 12 and substrate 15, respectively. In this case, the LED chips mounted on substrate 12 and substrate 15 are sealed with a sealant such as a phosphor-containing resin.

Substrate 12 and substrate 15 are, for example, ceramic substrates made of, for example, alumina, resin substrates made of resin, or insulated metal substrates consisting of a metal baseplate covered by a layer of insulating material. Substrate 12 and substrate 15 have a shape in plan view corresponding to the shape of the mounting surface on heat sink 30 to which substrate 12 and substrate 15 are mounted.

High beam light source module 10 having such as structure is fixed to first heat sink 31 of heat sink 30. More specifically, substrate 12 is mounted and fixed to a predetermined mounting surface on first heat sink 31. Moreover, in the first embodiment, substrate 12 is arranged standing (i.e., vertically) so that high beam light source module 10 projects light in a forward direction. In other words, the optical axis of high beam light source module 10 (high beam light emitting device 11) is parallel to the Z axis.

Low beam light source module 13 is fixed to second heat sink 32 of heat sink 30. More specifically, substrate 15 is mounted and fixed to a predetermined mounting surface on second heat sink 32. Moreover, in the first embodiment, substrate 15 is arranged laying flat (i.e., horizontally) so that low beam light source module 13 projects light in an upward direction. In other words, the optical axis of low beam light source module 13 (low beam light emitting device 14) is parallel to the Y axis.

Lens Body

As illustrated in FIG. 2 through FIG. 5, high beam lens unit 21 and low beam lens unit 22 are integrally formed together to form lens body 20. For example, lens body 20 can be made by, for example, injection molding using a clear resin such as acryl, polycarbonate, or cyclic olefin. Note that high beam lens unit 21 and low beam lens unit 22 are not required to be integrally formed.

As described above, high beam lens unit 21 is disposed in front of high beam light source module 10 and configured of three collimating lenses—first collimating lens 21*a*, first collimating lens 21*b*, and second collimating lens 21*c*.

As illustrated in FIG. 6, light emitted forward by first high beam light emitting device 11*a*, first high beam light emitting device 11*b*, and second high beam light emitting device 11*c* passes through first collimating lens 21*a*, first collimating lens 21*b*, and second collimating lens 21*c* and travels forward as collimated light.

More specifically, first collimating lens 21*a*, first collimating lens 21*b*, and second collimating lens 21*c* each have a truncated cone shape whose diameter increases toward the front. The plurality of high beam light emitting devices 11 (first high beam light emitting device 11*a*, first high beam light emitting device 11*b*, and second high beam light emitting device 11*c*) are disposed in the smaller diameter regions of these truncated cones (i.e., toward the back).

With this configuration, light emitted by first high beam light emitting device 11*a*, first high beam light emitting device 11*b*, and second high beam light emitting device 11*c* is collimated by totally reflecting off the inner face of the truncated conical and curved outer wall. The collimated light then exits the front surface (planar surface) of first collimating lens 21*a*, first collimating lens 21*b*, and second collimating lens 21*c*, and travels forward.

Low beam lens unit 22 is disposed in front of low beam light source module 13. Low beam lens unit 22 is also disposed in front of shield 40. More specifically, low beam lens unit 22 is disposed so as to cover an opening formed in front of shield 40.

The lower portion of low beam lens unit 22 has the shape of a quarter slice of a sphere (one quarter of a sphere), and the upper portion has the shape of one quarter of a sphere with portions in front of the three lenses included in high beam lens unit 21 removed.

As illustrated in FIG. 6, light emitted upward by low beam light emitting device 14 is reflected off reflector 41 of shield 40 and enters low beam lens unit 22. The optical properties of low beam lens unit 22 direct the light, and the light exits forward from the front surface (curved surface) of low beam lens unit 22.

Heat Sink

Heat sink 30 is a heat dissipating component for dissipating heat generated by high beam light source module 10 and low beam light source module 13 (to the atmosphere). Consequently, heat sink 30 is preferably made of a material with a high rate of heat transfer, such as metal. Heat sink 30 is, for example, an aluminum die cast heat sink made from composite aluminum.

As illustrated in FIG. 5, heat sink 30 is divided into first heat sink 31 and second heat sink 32. In other words, first heat sink 31 and second heat sink 32 are integrally combined to form heat sink 30. First heat sink 31 and second heat sink 32 each include a plurality of heat dissipating fins.

First heat sink 31 is a heat dissipating component for dissipating heat generated mainly by high beam light source module 10 (high beam light emitting device 11). First heat sink 31 includes a mounting surface (installation surface) for mounting high beam light source module 10.

Second heat sink 32 is a heat dissipating component for dissipating heat generated mainly by low beam light source module 13 (low beam light emitting device 14). Second heat sink 32 includes a mounting surface (installation surface) for mounting low beam light source module 13.

In the first embodiment, the front end portion of first heat sink 31 protrudes further forward than the front end portion of second heat sink 32. This allows high beam light source module 10 to be disposed further forward than low beam light source module 13.

Shield

Shield 40 is for defining a predetermined cut-off line. Shield 40 defines the predetermined cut-off line by shielding a portion of the light emitted by low beam light source module 13. As illustrated in FIG. 5, shield 40 is disposed in the space between low beam lens unit 22 and heat sink 30. Shield 40 may be formed by plastics molding using a black or dark colored heat resistant resin, for example. Note that shield 40 may be metal instead of resin.

As illustrated in FIG. 5, in the first embodiment, reflector 41 is disposed on shield 40. Reflector 41 is disposed above low beam light source module 13 and reflects light emitted upward by low beam light source module 13. Reflector 41 has a curved reflective surface so as to reflect light forward at a downward sloping angle toward low beam lens unit 22. Reflector 41 is formed by giving a portion of shield 40 a mirror finish. For example, reflector 41 may be formed on shield 40 by forming a metal deposition film (for example, an aluminum deposition film) on a portion of shield 40 (heat resistant resin).

Note that reflector 41 and shield 40 may be separate components instead of being formed integrally.

Next, light restrictor 60, which is integrally formed with shield 40, will be described with reference to FIG. 7 through FIG. 10.

Figure 7:
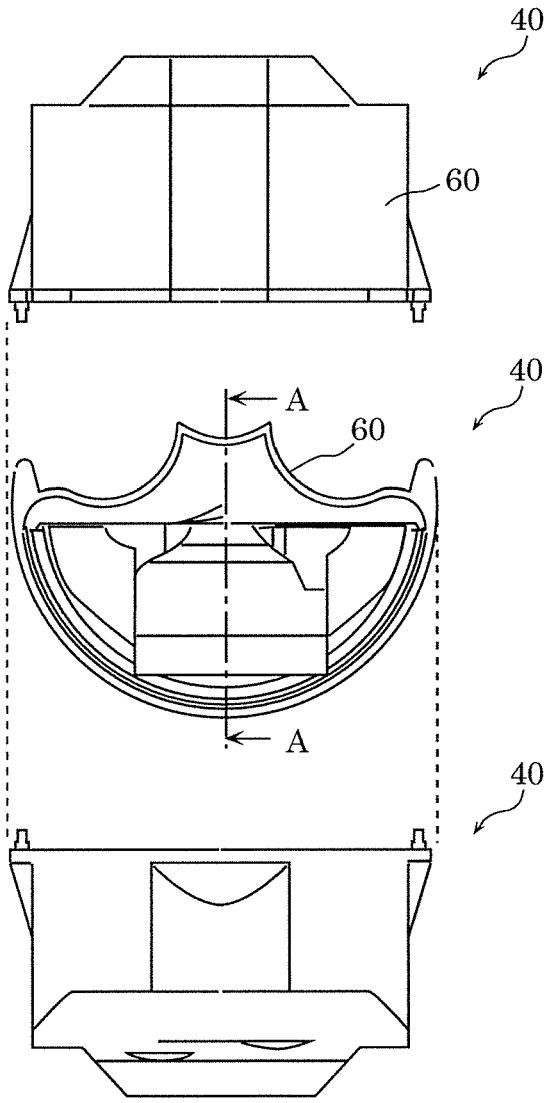
FIG. 7 illustrates a top, front, and bottom view of a shield according to one example of the present invention.
Figure 8:
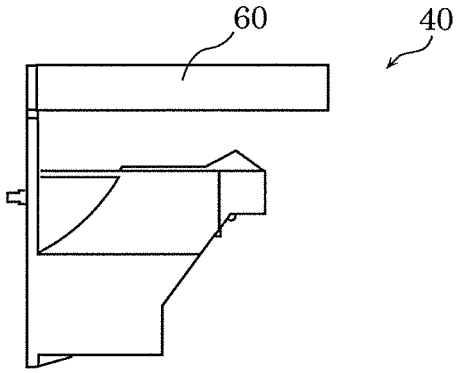
FIG. 8 is a side view of a shield according to one example of the present invention.
Figure 9:
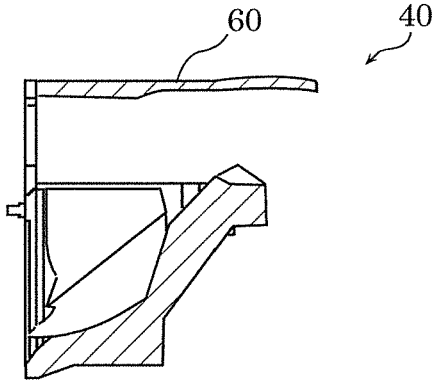
FIG. 9 is a cross sectional side view of a shield according to one example of the present invention.

FIG. 7 illustrates a top, front, and bottom view of shield 40 according to the first embodiment. FIG. 8 is a side view of shield 40 according to the first embodiment. FIG. 9 is a cross sectional view of shield 40 according to the first embodiment illustrated from the side.

As illustrated in FIG. 6, shield 40 is disposed behind low beam lens unit 22 and defines a boundary line (in particular, a cut-off line) for light emitted forward by low beam light emitting device 14 (i.e., second light emitting device). Moreover, shield 40 is disposed below high beam lens unit 21.

As illustrated in FIG. 7 through FIG. 9, light restrictor 60 is integrally formed with shield 40, and restricts light emitted by low beam light emitting device 14 (i.e., second light emitting device) from entering high beam lens unit 21 (i.e., first lens body). In FIG. 7, light restrictor 60 has a curved surface that corresponds to the sides (i.e., the bottoms) of first collimating lens 21*a*, first collimating lens 21*b*, and second collimating lens 21*c*. Since shield 40 is made from an opaque resin or metal, light restrictor 60 can restrict or prevent light emitted by low beam light emitting device 14 from entering high beam lens unit 21.

Edge Portion of Light Restrictor

Next, the connection of the edge portion of light restrictor 60 and reflector 41 will be discussed.

Figure 10:
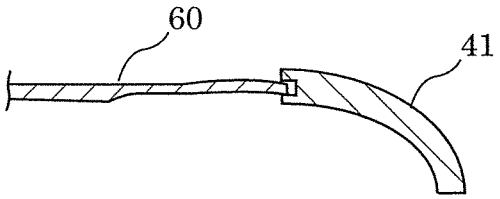
FIG. 10 is an enlarged cross sectional view of a portion of a light restrictor and a reflector according to one example of the present invention.

FIG. 10 is an enlarged cross sectional view of a portion of light restrictor 60 and reflector 41 (reflector) according to the first embodiment. As illustrated in FIG. 10, light restrictor 60 is connected to the edge portion of reflector 41. Here, at least one of the edge portion of light restrictor 60 or the edge portion of reflector 41 includes a recessed portion, and light restrictor 60 and reflector 41 are in contact via this recessed portion. In the example illustrated in FIG. 10, reflector 41 includes the recessed portion (illustrated as a groove in FIG. 10), which is in contact with the edge portion of light restrictor 60.

As described above, with lighting apparatus 1 according to the first embodiment, light restrictor 60 is capable of reducing the amount of or preventing light leaking from low beam light emitting device 14 toward high beam lens unit 21. This increases the lighting efficiency. Moreover, since light restrictor 60 is integrally formed with shield 40, manufacturing costs are reduced.

Second Embodiment

In the first embodiment, light restrictor 60 is exemplified as being integrally formed with shield 40, but in the second embodiment, light restrictor 60 is integrally formed with heat sink 30.

Figure 11:
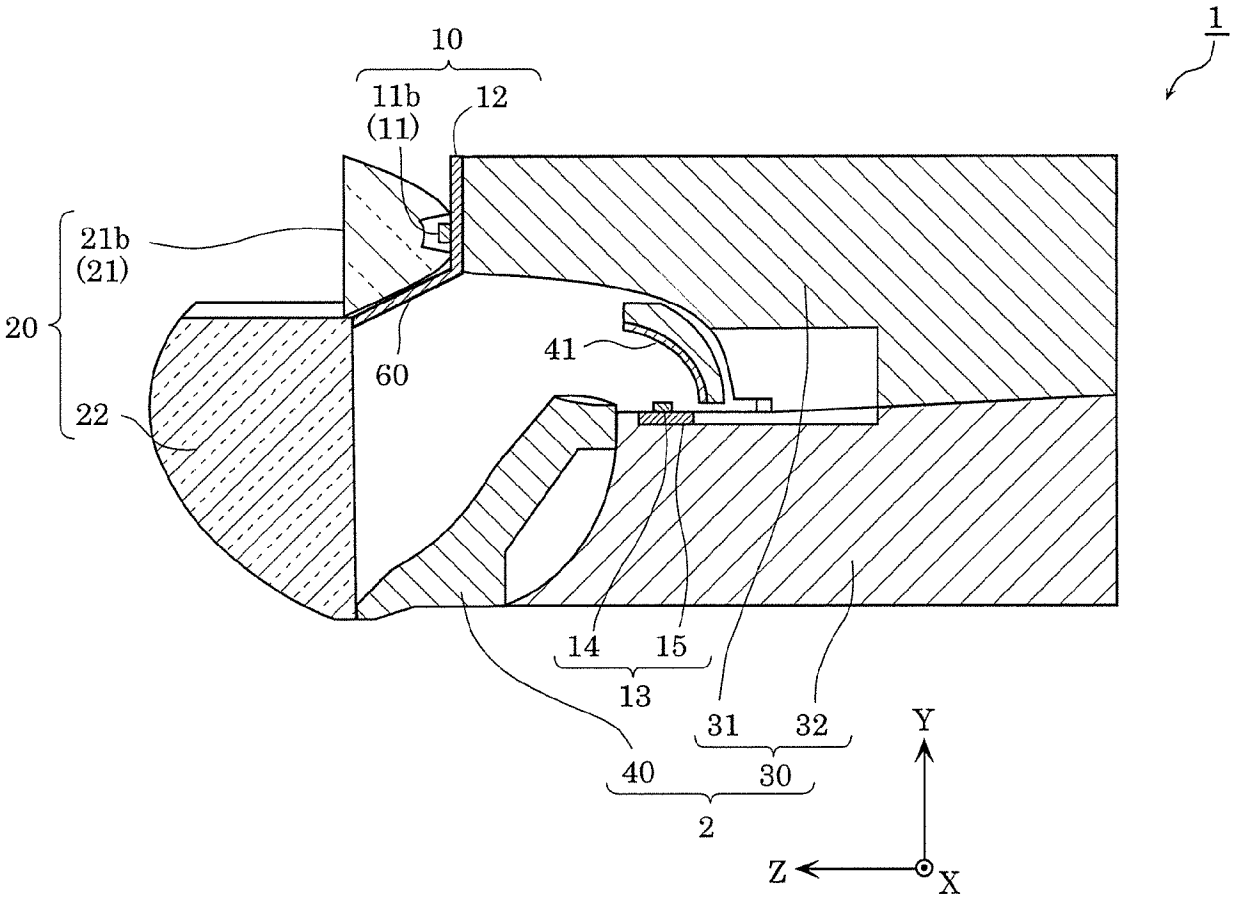
FIG. 11 is a cross sectional view of a lighting apparatus according to one example of the present invention.

FIG. 11 is a cross sectional view of lighting apparatus 1 according to the second embodiment. Different from FIG. 5, lighting apparatus 1 in FIG. 11 includes light restrictor 60 that is integrally formed with heat sink 30 instead of shield 40. The following description will focus on this difference.

In FIG. 11, light restrictor 60 is integrally formed with heat sink 30. Heat sink 30 includes first heat sink 31 and second heat sink 32. In FIG. 11, light restrictor 60 is integrally formed with first heat sink 31 included in heat sink 30.

Figure 12:
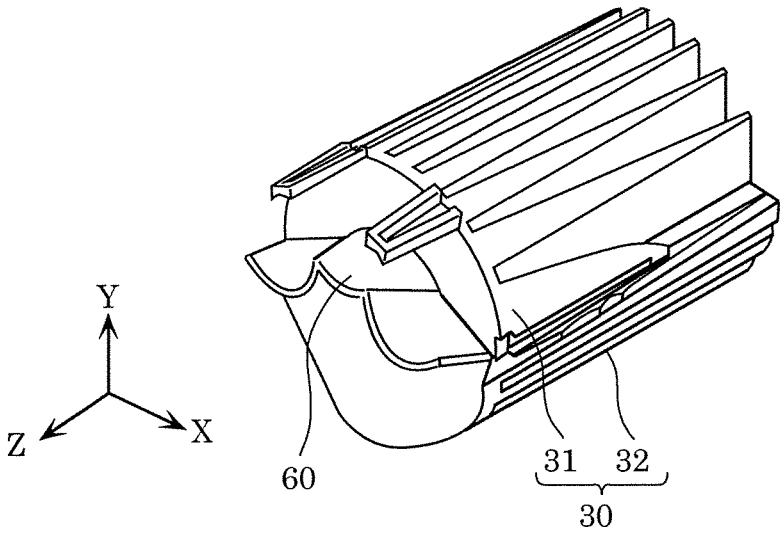
FIG. 12 is a perspective view of a heat sink according to one example of the present invention.
Figure 13:
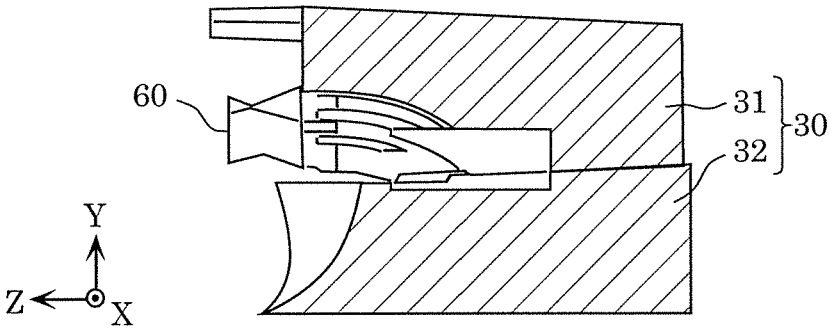
FIG. 13 is a cross sectional view of a heat sink according to one example of the present invention.
Figure 14:
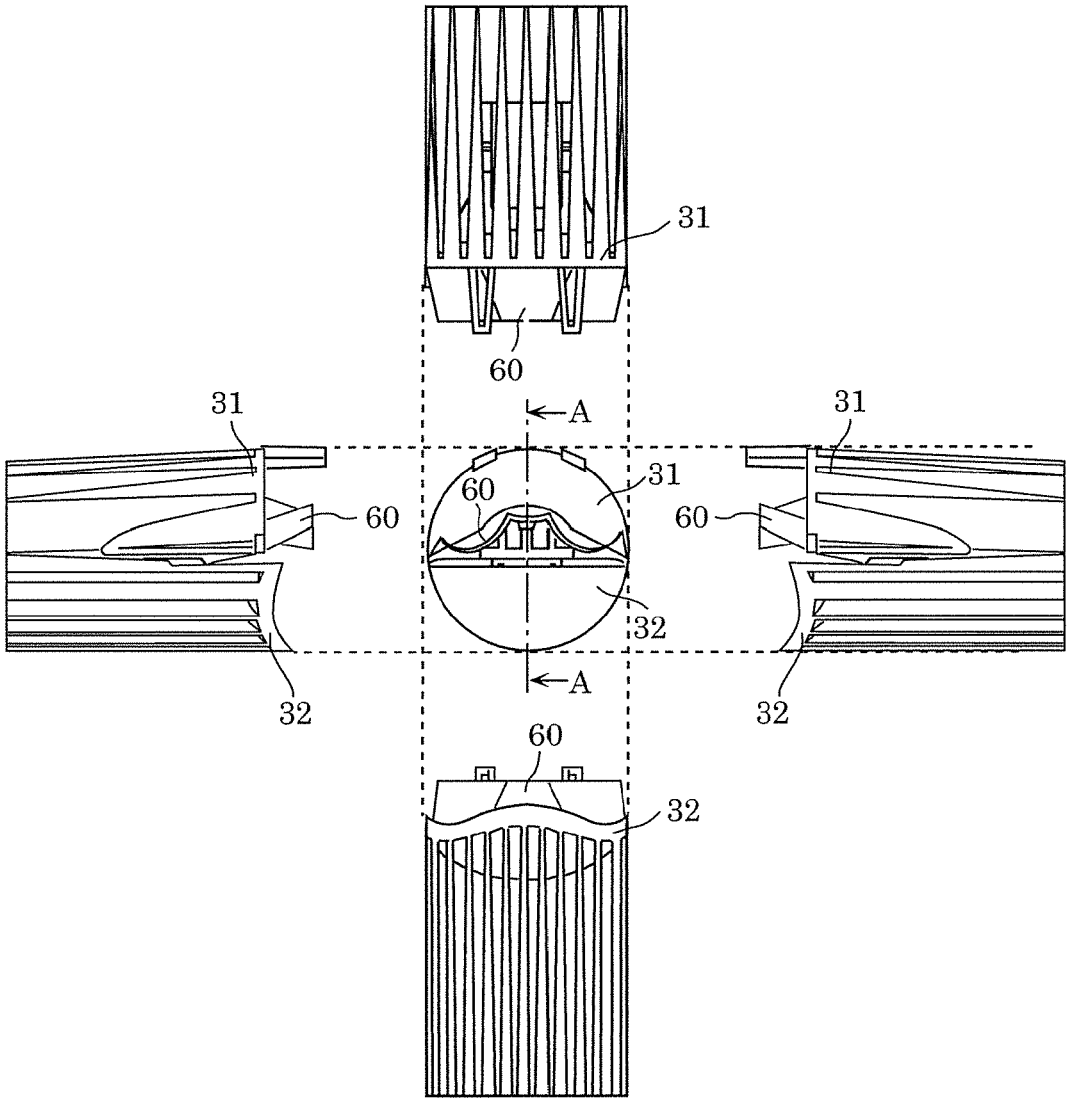
FIG. 14 illustrates front, top, bottom, left, and right views of a heat sink according to one example of the present invention.

FIG. 12 is a perspective view of heat sink 30 according to the second embodiment. FIG. 13 is a cross sectional view of heat sink 30 according to the second embodiment. FIG. 14 illustrates a front, top, bottom, left, and right views of heat sink 30 according to the second embodiment.

Light restrictor 60 is integrally formed with first heat sink 31 and adjacent to first lens body (i.e., high beam lens unit 21). More specifically, light restrictor 60 has a curved surface that corresponds to the sides of first collimating lens 21*a*, first collimating lens 21*b*, and second collimating lens 21*c*. First heat sink 31 is made of a metal such as aluminum. Consequently, light restrictor 60 can restrict or prevent light from entering.

As described above, with lighting apparatus 1 according to the second embodiment, light restrictor 60 is capable of reducing the amount of or preventing light leaking from low beam light emitting device 14 toward high beam lens unit 21. This increases the lighting efficiency. Moreover, since light restrictor 60 is integrally formed with heat sink 30, manufacturing costs are reduced.

Note that the two protrusions disposed on the front (Z axis direction) top (Y axis direction) portion of first heat sink 31 are provided to support the top portions of high beam light source module 10 and high beam lens unit 21.

Variations

Next, as a variation of light restrictor 60, an example will be given where a portion of light restrictor 60 is integrally formed with shield 40 and the remaining portion is integrally formed with heat sink 30.

Figure 15:
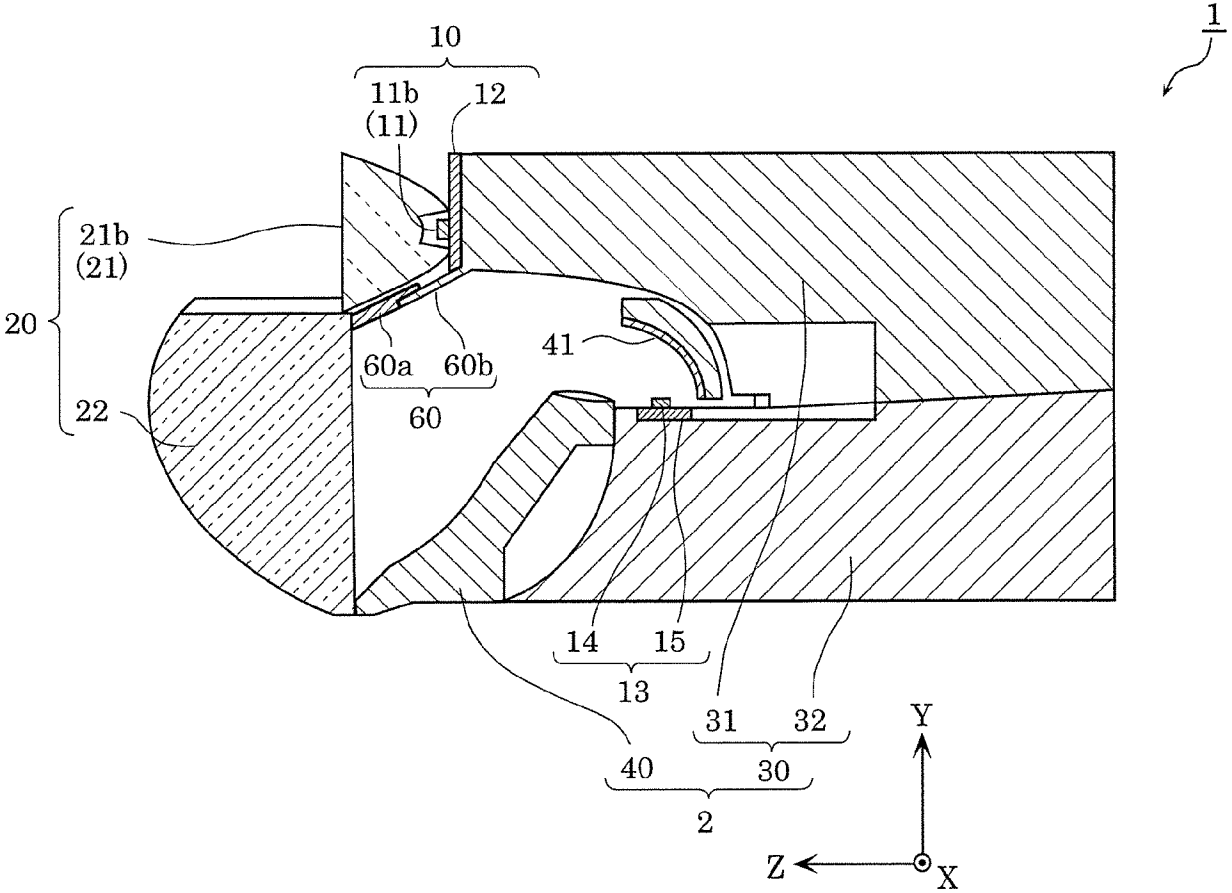
FIG. 15 is a cross sectional view of a lighting apparatus according to one example of the present invention.

FIG. 15 is a cross sectional view of lighting apparatus 1 according to this variation. In contrast to FIG. 5, lighting apparatus 1 illustrated in FIG. 15 includes light restrictor 60 that has a portion integrally formed with shield 40 and the remaining portion integrally formed with heat sink 30, instead of the entirety of light restrictor 60 being integrally formed with shield 40. The following description will focus on this difference.

As illustrated in FIG. 15, light restrictor 60 includes a first component (light restrictor 60*a*) integrally formed with shield 40 and a second component (light restrictor Gob) integrally formed with heat sink 30.

The first component (light restrictor 60*a*) and the second component (light restrictor 60*b*) partially overlap one another. This overlapping portion eliminates any gap between the portion where the first component and the second component connect.

Moreover, the protruding portions of the first component and the second component resulting from the integral design (i.e., the length of light restrictor 60 in the anteroposterior direction) are shorter than the first and second embodiments. This consequently makes formation (manufacturing) of shield 40 and heat sink 30 more simple.

Next, the method used to fix low beam light source module 13 mounted on second heat sink 32 will be described.

Figure 16A:
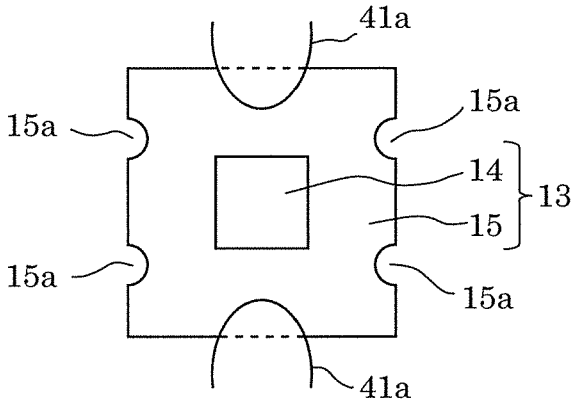
FIG. 16A illustrates an example of a configuration of a low beam light source module according to one example of the present invention.

FIG. 16A illustrates an example of a configuration of low beam light source module 13 according to this variation. Low beam light source module 13 includes substrate 15 and low beam light emitting device 14 mounted on substrate 15. Low beam light emitting device 14 is mounted in the center portion of substrate 15. Substrate 15 includes four recessed portions 15*a*.

The four recessed portions 15*a* abut against substrate stops disposed on second heat sink 32 on which substrate 15 is mounted. Recessed portions 15*a* in FIG. 16A are semi-circular notches. The substrate stops disposed on second heat sink 32 inhibit movement of substrate 15 in a direction parallel to the surface of substrate 15, and are, for example, protruding portions formed in locations corresponding to recessed portions 15*a* and shaped so as to be in contact with recessed portions 15*a*.

Moreover, movement of substrate 15 in a direction perpendicular to the surface of substrate 15 is restricted by substrate retainer 41*a*. Substrate retainer 41*a* is disposed on and integrally formed with base 2 (e.g., first heat sink 31). Note that substrate retainer 41*a* and reflector 41 may be integrally formed with first heat sink 31.

With this configuration of substrate 15, the substrate stop, and substrate retainer 41*a*, movement of substrate 15 in directions both parallel and perpendicular to the surface of substrate 15 can be easily inhibited. In other words, positional deviation of substrate 15 can be easily inhibited.

Figure 16B:
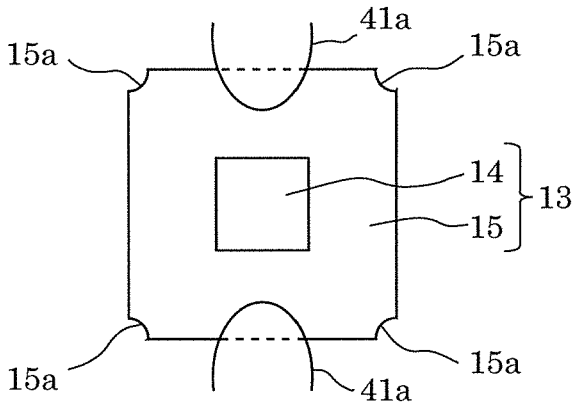
FIG. 16B illustrates an example of a different configuration of a low beam light source module according to one example of the present invention.

FIG. 16B illustrates an example of a different configuration of low beam light source module 13 according to this variation. In contrast to FIG. 16A, substrate 15 in FIG. 16B includes recessed portions 15*a* for accepting the substrate stops, in the four corners thereof. In other words, similar to FIG. 16A, positional deviation of this substrate 15 can be easily inhibited as well. Moreover, forming recessed portions 15*a* in the four corners of substrate 15 makes manufacturing of substrate 15 easier. In other words, when multiple substrates 15 are manufactured from a single multi-pattern substrate, the number of hole punches required is fewer than the example illustrated in FIG. 16A.

Note that in FIG. 16A and FIG. 16B, substrate 15 may include three or fewer recessed portions 15*a*. The number of protruding portions included as substrate stops is equal to the number of recessed portions 15*a*.

Summary of First and Second Embodiments

As described above, lighting apparatus 1 according to the first and second embodiments is a lighting apparatus for vehicle use that projects light forward, and includes: base 2; first light emitting device 11 disposed on base 2; second light emitting device 14 disposed on base 2; first lens body 21 disposed in front of first light emitting device 11; second lens body 22 disposed in front of second light emitting device 14; and light restrictor 60 adjacent to first lens body 21, light restrictor 60 restricting light emitted by second light emitting device 14 from entering first lens body 21

With this, leak light from the second light emitting device (low beam light emitting device 14) can be restricted from entering the first lens body (high beam lens unit 21).

Here, base 2 may include: heat sink 30 that dissipates heat from first light emitting device 11 and second light emitting device 14; and shield 40 that defines a cut-off line for light emitted forward by second light emitting device 14, and light restrictor 60 may be integrally formed with at least one of heat sink 30 and shield 40.

With this, since the light restrictor is integrally formed with the base, manufacturing costs are reduced.

Here, light restrictor 60 may be integrally formed with shield 40.

With this, since the light restrictor is integrally formed with the shield, manufacturing costs are reduced.

Here, light restrictor 60 may be integrally formed with heat sink 30.

With this, since the light restrictor is integrally formed with the heat sink, manufacturing costs are reduced.

Here, light restrictor 60 may include first component 60*a* integrally formed with shield 40 and second component 60*b* integrally formed with heat sink 30, and first component 60*a* and second component 60*b* may at least partially overlap one another.

With this, since a portion of the light restrictor is integrally formed with the shield, and the remaining portion is integrally formed with the heat sink, formation (manufacturing) is simplified.

Here, shield 40 may include reflector 41 that reflects light from second light emitting device 14 toward second lens body 22, and light restrictor 60 may be connected to an edge portion of reflector 41.

This makes it possible to reduce or prevent light leak at the portion where the light restrictor and the reflector are connected.

Here, at least one of an edge portion of light restrictor 60 and the edge portion of reflector 41 may include a recessed portion, and the edge portion of light restrictor 60 and the edge portion of reflector 41 may be connected via the recessed portion.

This makes it possible to reduce or prevent light leak at the portion where the light restrictor and the reflector are connected.

Here, the lighting apparatus may include substrate 15 on which second light emitting device 14 is mounted, and base 2 may include: substrate retainer 41*a* that restricts movement of substrate 15 in a direction perpendicular to a surface of substrate 15; and a substrate stop that inhibits movement of substrate 15 in a direction parallel to the surface of substrate 15.

With this, movement of the substrate in directions both parallel and perpendicular to the surface of the substrate can be easily inhibited. In other words, positional deviation of the substrate can be easily inhibited.

Here, substrate 15 may be substantially rectangular and may include, in a corner, recessed portion 15*a* abutting the substrate stop.

With this, since recessed portions 15*a* are formed in the four corners of the substrate, manufacturing of the substrate is easier.

Here, one of first light emitting device 11 and second light emitting device 14 may be a low beam light source for use in an automobile, and the remaining one of first light emitting device 11 and second light emitting 14 device may be a high beam light source for use in the automobile.

This makes it possible to restrict light leaking from second light emitting device toward first lens body in the automobile, in particular.

Here, lighting apparatus 1 may further include first light source module 10 disposed on base 2 and second light source module 13 disposed on base 2, wherein first light source module 10 may include substrate 12 and a plurality of first light emitting devices 11 mounted on substrate 12, second light source module 13 may include second light emitting device 14, first lens body 21 may include a plurality of lenses (for example, first collimating lens 21*a*, first collimating lens 21*b*, and second collimating lens 21*c*) disposed in front of the plurality of first light emitting devices 11 in a one-to-one relationship, substrate 12 may be held down onto base 2 by substrate retainer 21*e*, 21*f*, and substrate retainer 21*e*,21*f* may be disposed in a position that does not overlap with the plurality of lenses in a front view of lighting apparatus 1.

Here, base 2 may include heat sink 30, heat sink 30 may include first heat sink 31 thermally coupled to first light emitting device 11 and second heat sink 32 thermally coupled to second light emitting device 14, and first heat sink 31 and second heat sink 32 may be adjoined in a direction intersecting the anteroposterior direction.

Moreover, automobile 100 according to each embodiment includes the above-described lighting apparatus 1.

This makes it possible to restrict light leaking from second light emitting device toward first lens body.

Other Variations

Although the lighting apparatus, automobile, etc., according to the present disclosure have been described based on the above embodiments and variations thereof, the present disclosure is not limited thereto.

For example, light restrictor 60 is exemplified as being integrally formed with at least one of heat sink 30 or shield 40, but light restrictor 60 may be an independent component.

Third Embodiment

In the third embodiment, a lighting apparatus and automobile with which the light emitting devices and lenses can be accurately positioned.

Typically, the accuracy of the optical axis of the optical system of the lighting apparatus is critical in achieving a desired light distribution pattern when the low beams and the high beams are used. More specifically, the accuracy of positioning of the low beam light emitting device and the lens as well as the positioning of the high beam light emitting device and the lens is critical. However, accurately positioning these light emitting devices and lenses is not simple.

Accordingly, a lighting apparatus according to one aspect of the third embodiment that is for vehicle use and projects light forward is provided. The lighting apparatus includes: a first light source module disposed on the base; a second light source module disposed on the base; a first optical component disposed in front of the; and a second optical component disposed in front of the second light source module, wherein the first light source module includes a substrate and a plurality of first light emitting devices mounted on the substrate, the first optical component includes a plurality of lenses disposed in front of the plurality of the first light emitting devices in a one-to-one relationship, the substrate is held down onto the base by a substrate retainer, and the substrate retainer is disposed in a position that does not overlap with the plurality of lenses in a front view of the lighting apparatus.

With this, the positioning of the light emitting devices and lenses can be controlled, making it possible to increase the positioning accuracy of the light emitting devices and lenses.

The external view of automobile 100 according to the third embodiment is the same as illustrated in FIG. 1 and previously described.

Lighting Apparatus

Figure 17:
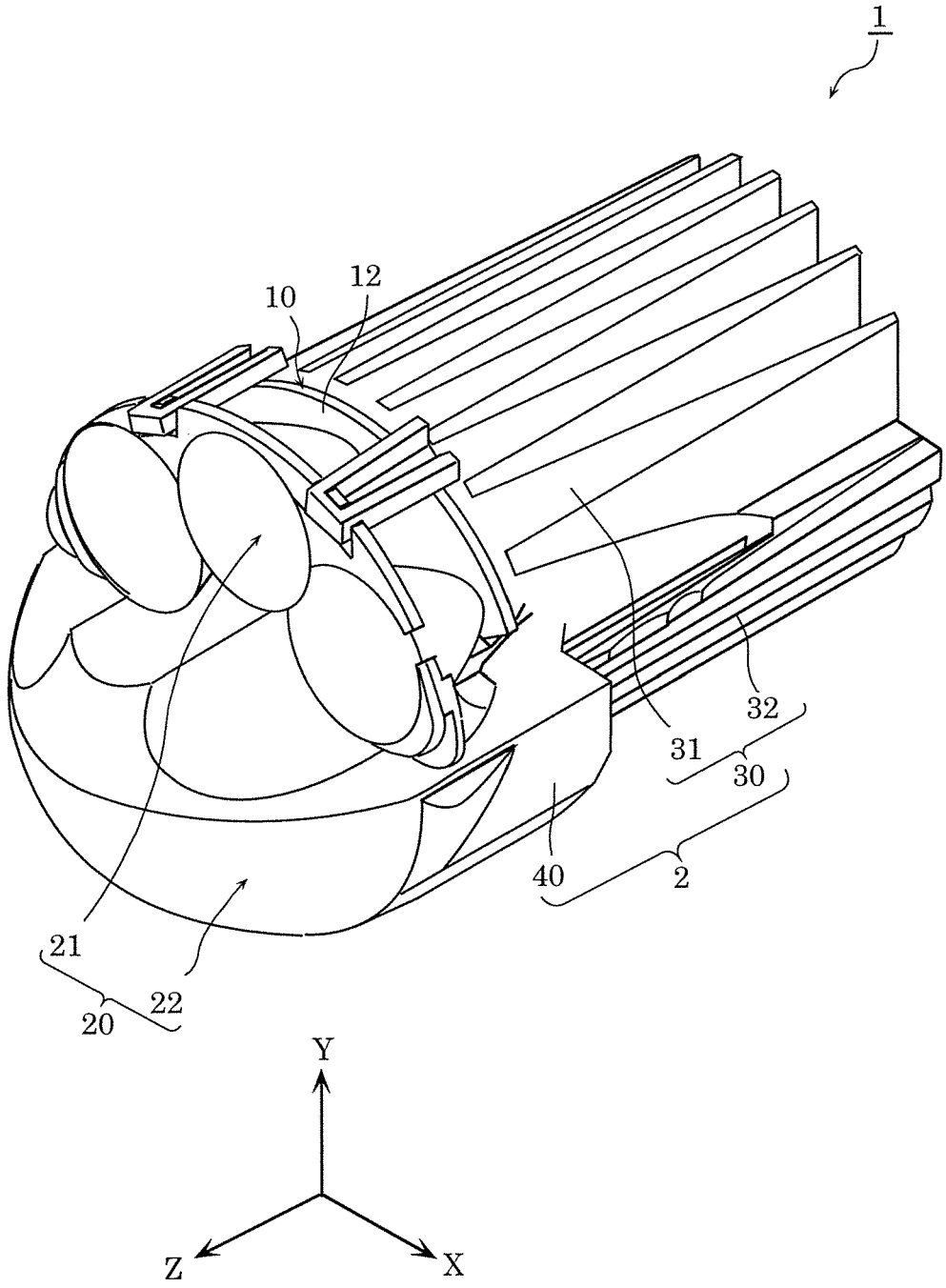
FIG. 17 is a perspective view of a lighting apparatus according to one example of the present invention.
Figure 18:
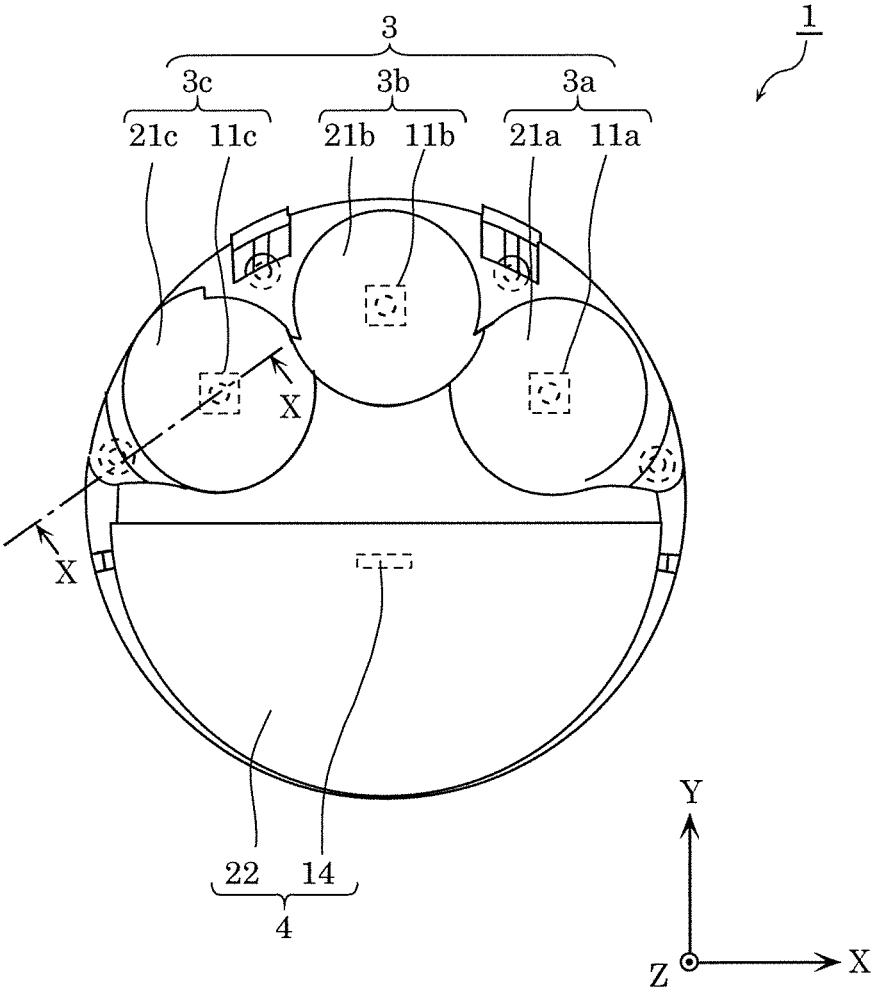
FIG. 18 is a front view of a lighting apparatus according to one example of the present invention.
Figure 19:
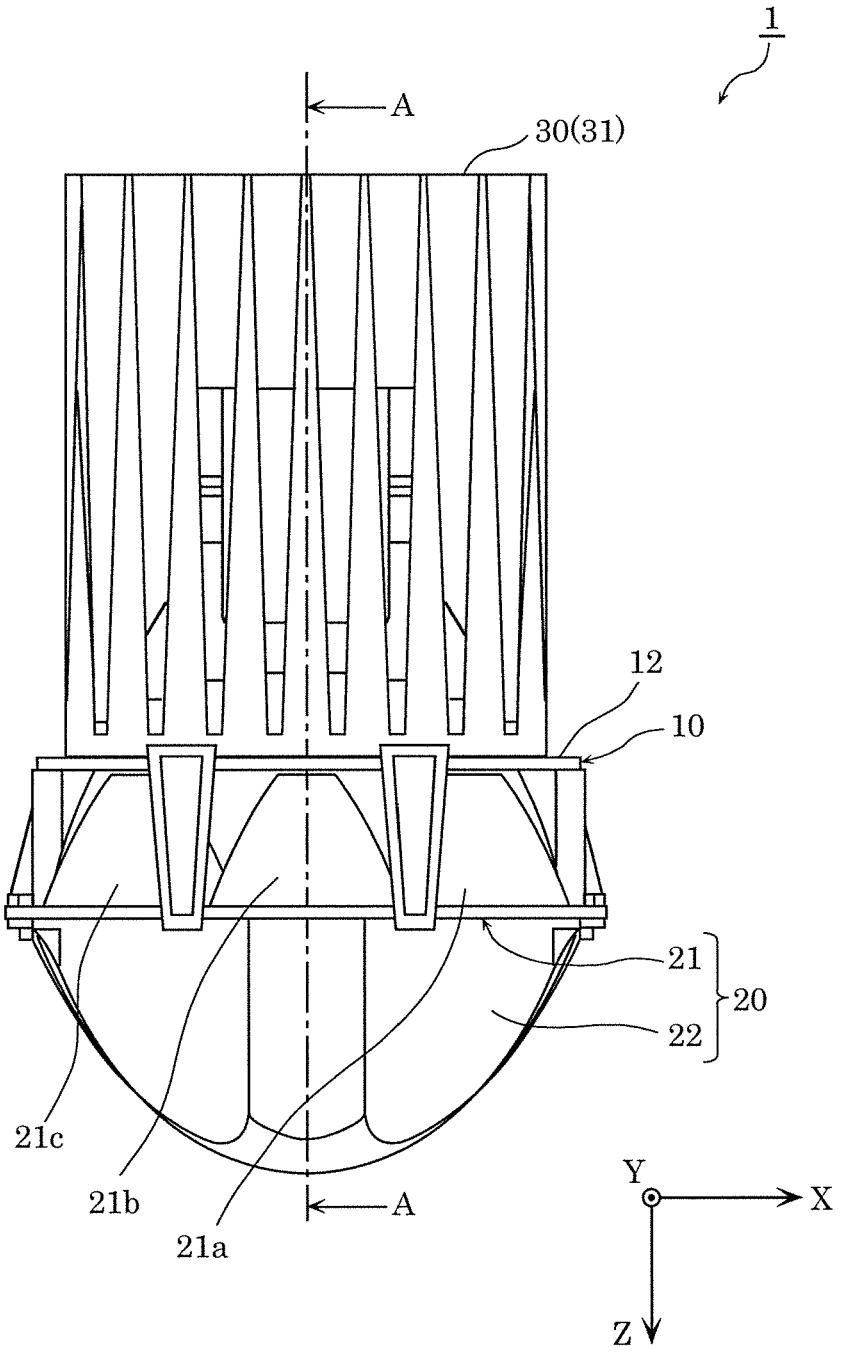
FIG. 19 is a top view of a lighting apparatus according to one example of the present invention.
Figure 20:
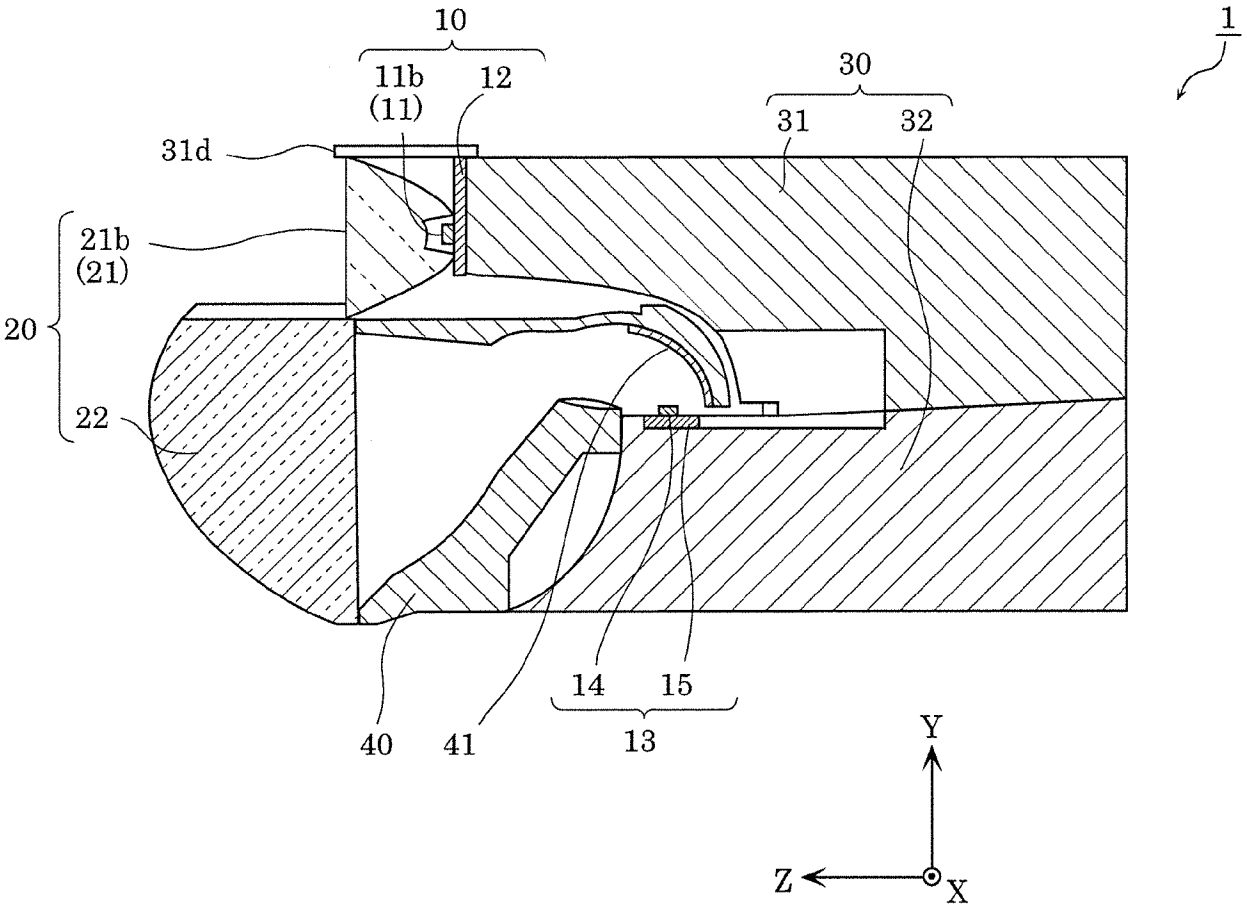
FIG. 20 is a cross sectional view of a lighting apparatus according to one example of the present invention taken at line A-A in FIG. 19.

Next, lighting apparatus 1 according to the third embodiment will be described with reference to FIG. 17 through FIG. 20, and FIG. 6. FIG. 17 is a perspective view of the lighting apparatus according to the third embodiment, FIG. 18 is a front view of the same lighting apparatus, FIG. 19 is a top view of the same lighting apparatus, and FIG. 20 is a cross sectional view of the same lighting apparatus taken at line A-A in FIG. 19. FIG. 6 is a cross sectional view of the same lighting apparatus taken at line A-A in FIG. 19, and illustrates light paths of the light emitted when the high beams and the low beams are used.

Lighting apparatus 1 according to the third embodiment is a vehicle lighting apparatus used in, for example, a vehicle headlight, and projects light forward. As illustrated in FIG. 17 through FIG. 20, the main body of lighting apparatus 1 includes high beam light source module 10, low beam light source module 13, lens body 20, heat sink 30, and shield 40. Lighting apparatus 1 further includes a lighting controller (not shown in FIG. 17 through FIG. 20) that controls high beam light source module 10 and low beam light source module 13.

As illustrated in FIG. 20, high beam light source module 10 includes high beam light emitting device (first light emitting device) 11 and substrate 12 for high beam use, on which high beam light emitting device 11 is mounted. Low beam light source module 13 includes low beam light emitting device (second light emitting device) 14 and substrate 15 for low beam use, on which low beam light emitting device 14 is mounted.

As illustrated in FIG. 20, lens body 20 is disposed in front of high beam light source module 10 (high beam light emitting device 11) and low beam light source module 13 (low beam light emitting device 14). As illustrated in FIG. 19, lens body 20 includes high beam lens unit 21 and low beam lens unit 22. High beam lens unit 21 is configured of three collimating lenses (first collimating lens 21*a*, first collimating lens 21*b*, and second collimating lens 21*c*).

As illustrated in FIG. 20, heat sink 30 is configured of two heat dissipating components—first heat sink 31 thermally coupled to high beam light emitting device 11 and second heat sink 32 thermally coupled to low beam light emitting device 14.

In the third embodiment, heat sink 30 and shield 40 together form base 2, and high beam light source module 10 and low beam light source module 13 are disposed on base 2. In other words, high beam light emitting device 11 and low beam light emitting device 14 are disposed on base 2.

As illustrated in FIG. 18, high beam light source module 10 and high beam lens unit 21 together form high beam lamp 3. High beam lamp 3 is an optical system for producing a high beam having a desired light distribution pattern. More specifically, high beam lamp 3 includes first high beam lamp 3*a*, first high beam lamp 3*b*, and second high beam lamp 3*c*.

Note that although two first high beam lamps 3*a* and 3*b* are exemplified here, a configuration including one is acceptable as well. Moreover, high beam lamp 3 may be only one of first high beam lamp 3*a*, first high beam lamp 3*b*, and second high beam lamp 3*c*.

As illustrated in FIG. 18, low beam light source module 13 and low beam lens unit 22 together form low beam lamp 4. Low beam lamp 4 is an optical system for producing a low beam having a desired light distribution pattern.

Note that high beam lamp 3 and low beam lamp 4 may include other optical components.

As illustrated in FIG. 18 and FIG. 19, high beam light source module 10, low beam light source module 13, lens body 20, heat sink 30, and shield 40 are arranged so as to fit in a given circular region when viewed along the Z axis, and in the third embodiment, are arranged so as to fit in a $\phi$70 mm region.

Hereinafter, each structural element will be described in detail.

Light Source Modules

High beam light source module (first light source module) 10 is an LED module for producing the high beam, and is used to illuminate an area a far distance ahead. Low beam light source module (second light source module) 13 is an LED module for producing the low beam, and is used to illuminate the road immediately ahead.

As the high beam light source, a plurality of high beam light emitting devices 11 (first high beam light emitting device 11*a*, first high beam light emitting device 11*b*, and second high beam light emitting device 11*c*) are mounted on substrate 12 in high beam light source module 10. In the third embodiment, first high beam light emitting device 11*a*, first high beam light emitting device 11*b*, and second high beam light emitting device 11*c* are mounted so as to correspond to first collimating lens 21*a*, first collimating lens 21*b*, and second collimating lens 21*c*, respectively. As the low beam light source, low beam light emitting device 14 is mounted on substrate 15 in low beam light source module 13.

High beam light source module 10 and low beam light source module 13 are, for example, white light sources, such as B-Y white LED light sources that use a blue LED chip and a yellow phosphor to emit white light. Alternatively, high beam light source module 10 and low beam light source module 13 may be white LED light sources that use an LED chip that emits red light, an LED chip that emits green light, and an LED chip that emits blue light to collectively emit white light.

Moreover, high beam light source module 10 and low beam light source module 13 may be surface mount device (SMD) modules, and alternatively may be chip on board (COB) modules.

When high beam light source module 10 and low beam light source module 13 are SMD modules, high beam light emitting device 11 and low beam light emitting device 14 are each an SMD LED mounted on an LED chip (bare chip) and sealed with a sealant (phosphor-containing resin) in a resin package. When high beam light source module 10 and low beam light source module 13 are COB modules, high beam light emitting device 11 and low beam light emitting device 14 are each LED chips themselves, and are directly mounted on substrate 12 and substrate 15, respectively. In this case, the LED chips mounted on substrate 12 and substrate 15 are sealed with a sealant such as a phosphor-containing resin.

Substrate 12 and substrate 15 are, for example, ceramic substrates made of, for example, alumina, resin substrates made of resin, or insulated metal substrates consisting of a metal baseplate covered by a layer of insulating material. Substrate 12 and substrate 15 have a shape in plan view corresponding to the shape of the mounting surface on heat sink 30 to which substrate 12 and substrate 15 are mounted.

High beam light source module 10 having such as structure is fixed to first heat sink 31 of heat sink 30. More specifically, substrate 12, on which high beam light emitting device 11 is mounted, is mounted and fixed to a predetermined mounting surface on first heat sink 31. Moreover, in the third embodiment, substrate 12 is arranged standing (i.e., vertically) so that high beam light source module 10 projects light in a forward direction. In other words, the optical axis of high beam light source module 10 (high beam light emitting device 11) is parallel to the Z axis.

Low beam light source module 13 is fixed to second heat sink 32 of heat sink 30. More specifically, substrate 15, on which low beam light emitting device 14 is mounted, is mounted and fixed to a predetermined mounting surface on second heat sink 32. Moreover, in the third embodiment, substrate 15 is arranged laying flat (i.e., horizontally) so that low beam light source module 13 projects light in an upward direction. In other words, the optical axis of low beam light source module 13 (low beam light emitting device 14) is parallel to the Y axis.

Lens Body

As illustrated in FIG. 17 through FIG. 20, lens body 20 is disposed in front of high beam light source module 10 (first high beam light emitting device 11*a*, first high beam light emitting device 11*b*, and second high beam light emitting device 11*c*) and low beam light source module 13 (low beam light emitting device 14).

In the third embodiment, high beam lens unit 21 and low beam lens unit 22 are integrally formed together to form lens body 20. For example, lens body 20 can be made by, for example, injection molding using a clear resin such as acryl, polycarbonate, or cyclic olefin. Note that high beam lens unit 21 and low beam lens unit 22 are not required to be integrally formed.

High beam lens unit 21 is a first optical component disposed in front of high beam light source module 10. As described above, high beam lens unit 21 is disposed in front of high beam light source module 10 and includes three lenses—first collimating lens 21*a*, first collimating lens 21*b*, and second collimating lens 21*c*.

The light paths for the high beam and the low beam are the same as illustrated in FIG. 6 and previously described.

Note that in the third embodiment, the optical axis of second collimating lens 21*c* is oblique to the optical axes of first collimating lens 21*a* and first collimating lens 21*b*. This makes it possible to horizontally space apart the center of the area illuminated by second high beam lamp 3*c* and the center of the area illuminated by first high beam lamp 3*a* and first high beam lamp 3*b*.

Heat Sink

Heat sink 30 is a heat dissipating component for dissipating heat generated by high beam light source module 10 and low beam light source module 13 (to the atmosphere). Consequently, heat sink 30 is preferably made of a material with a high rate of heat transfer, such as metal. Heat sink 30 is, for example, an aluminum die cast heat sink made from composite aluminum.

As illustrated in FIG. 20, heat sink 30 is divided into first heat sink 31 and second heat sink 32. In other words, first heat sink 31 and second heat sink 32 are assembled together to form heat sink 30. First heat sink 31 and second heat sink 32 are fixed together with, for example, screws. Note that first heat sink 31 and second heat sink 32 each include a plurality of heat dissipating fins.

First heat sink 31 is a heat dissipating component for dissipating heat generated mainly by high beam light source module 10 (high beam light emitting device 11). First heat sink 31 includes a mounting surface (installation surface) for mounting high beam light source module 10.

Second heat sink 32 is a heat dissipating component for dissipating heat generated mainly by low beam light source module 13 (low beam light emitting device 14). Second heat sink 32 includes a mounting surface (installation surface) for mounting low beam light source module 13.

In the third embodiment, the front end portion of first heat sink 31 protrudes further forward than the front end portion of second heat sink 32. This allows high beam light source module 10 to be disposed further forward than low beam light source module 13.

Shield

Shield 40 is for defining a predetermined cut-off line. Shield 40 defines the predetermined cut-off line by shielding a portion of the light emitted by low beam light source module 13. As illustrated in FIG. 20, shield 40 is disposed in the space between low beam lens unit 22 and heat sink 30. Shield 40 may be formed by plastics molding using a heat resistant resin, for example. Note that shield 40 may be metal instead of resin. Shield 40 is attached to, for example, second heat sink 32

As illustrated in FIG. 20, in the third embodiment, reflector 41 is disposed on shield 40. Reflector 41 is disposed above low beam light source module 13 and reflects light emitted upward by low beam light source module 13. Reflector 41 has a curved reflective surface so as to reflect light forward at a downward sloping angle toward low beam lens unit 22. Reflector 41 is formed by giving a portion of shield 40 a mirror finish. For example, reflector 41 may be formed on shield 40 by forming a metal deposition film (for example, an aluminum deposition film) on a portion of shield 40 (heat resistant resin).

Note that reflector 41 and shield 40 may be separate components instead of being formed integrally.

On/Off Control

Figure 21:
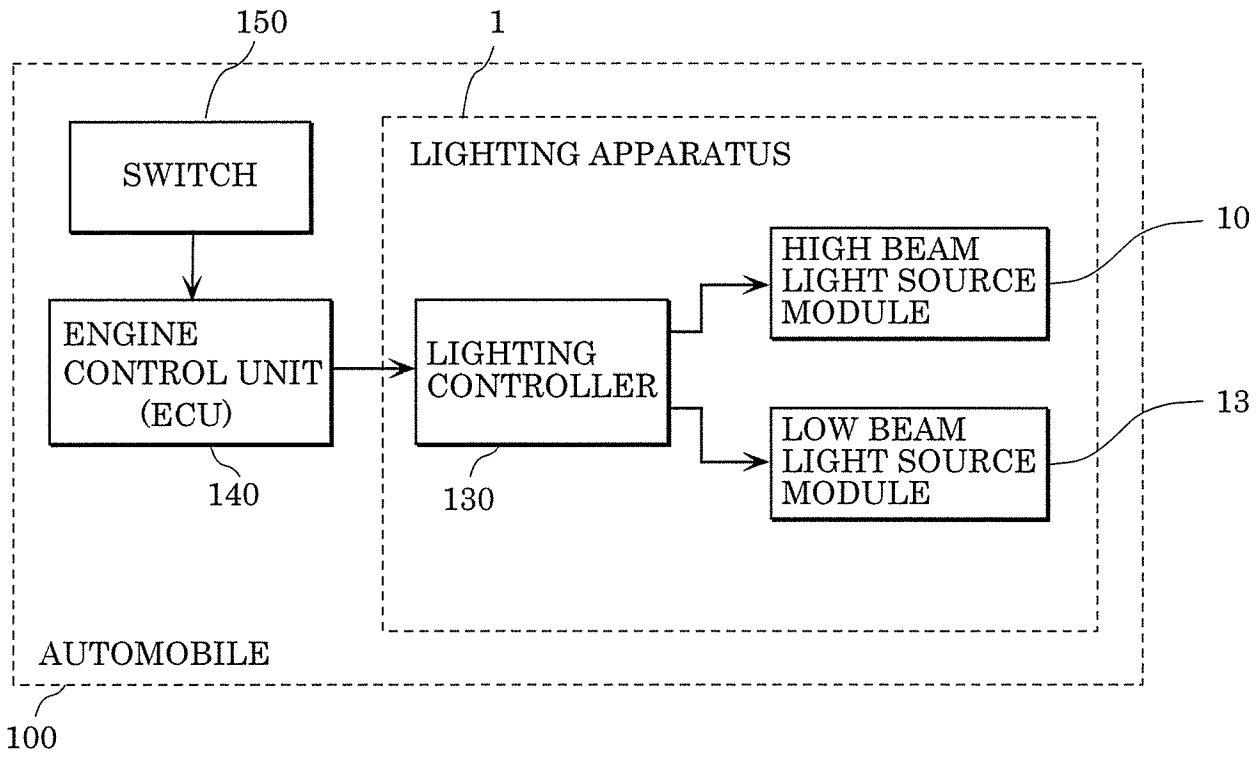
FIG. 21 is a block diagram illustrating a configuration relating to lighting functions of an automobile according to one example of the present invention.

FIG. 21 is a block diagram illustrating a configuration relating to lighting functions of the automobile according to the third embodiment. In other words, FIG. 21 is an illustration of when lighting apparatus 1 according to the third embodiment is installed in automobile 100.

As illustrated in FIG. 21, automobile 100 includes lighting apparatus 1, engine control unit 140, and switch 150. Lighting apparatus 1 includes a main body (high beam light source module 10 and low beam light source module 13) and lighting controller 130.

In the third embodiment, when the high beams are turned on, lighting controller 130 turns on high beam light source module 10 (first high beam light emitting device 11*a*, first high beam light emitting device 11*b*, and second high beam light emitting device 11*c*) and low beam light source module 13 (low beam light emitting device 14). In other words, lighting controller 130 turns on all light emitting devices when the high beams are turned on. When the low beams are turned on, however, lighting controller 130 only turns on low beam light emitting device 14.

Engine control unit (ECU) 140 controls the engine of automobile 100. Engine control unit 140 is, for example, a microcontroller. Lighting controller 130 and switch 150 are connected to engine control unit 140. Engine control unit 140 transmits an instruction input from switch 150 to lighting controller 130.

Switch 150 switches lighting apparatus 1 on and off. More specifically, switch 150 switches the low beams on and off and switches the high beams on and off. More specifically, switch 150 switches on and off high beam light source module 10 (first high beam light emitting device 11*a*, first high beam light emitting device 11*b*, and second high beam light emitting device 11*c*) and low beam light source module 13 (low beam light emitting device 14).

For example, when driving at night and an oncoming vehicle is present, the driver of automobile 100 operates switch 150 to cause lighting apparatus 1 to project the low beam. More specifically, lighting controller 130 turns on only low beam light source module 13 (low beam light emitting device 14) to form the low beam and illuminate the road with a predetermined low beam lighting pattern.

Moreover, when driving at night and an oncoming vehicle is not present, the driver of automobile 100 operates switch 150 to cause lighting apparatus 1 to project the high beam. More specifically, lighting controller 130 turns on high beam light source module 10 and low beam light source module 13 to form the high beam and illuminate the area ahead with a predetermined high beam lighting pattern.

Note that in the third embodiment, all light emitting devices are turned on when the high beams are turned on, but this example is not limiting. For example, only high beam light source module 10 may be turned on when the high beams are turned on, and only low beam light source module 13 may be turned on when the low beams are turned on. In other words, high beam light source module 10 and low beam light source module 13 may have a mutually exclusive relationship when turned on.

Configuration of High Beam Lens Unit and High Beam Light Source Module

Figure 22:
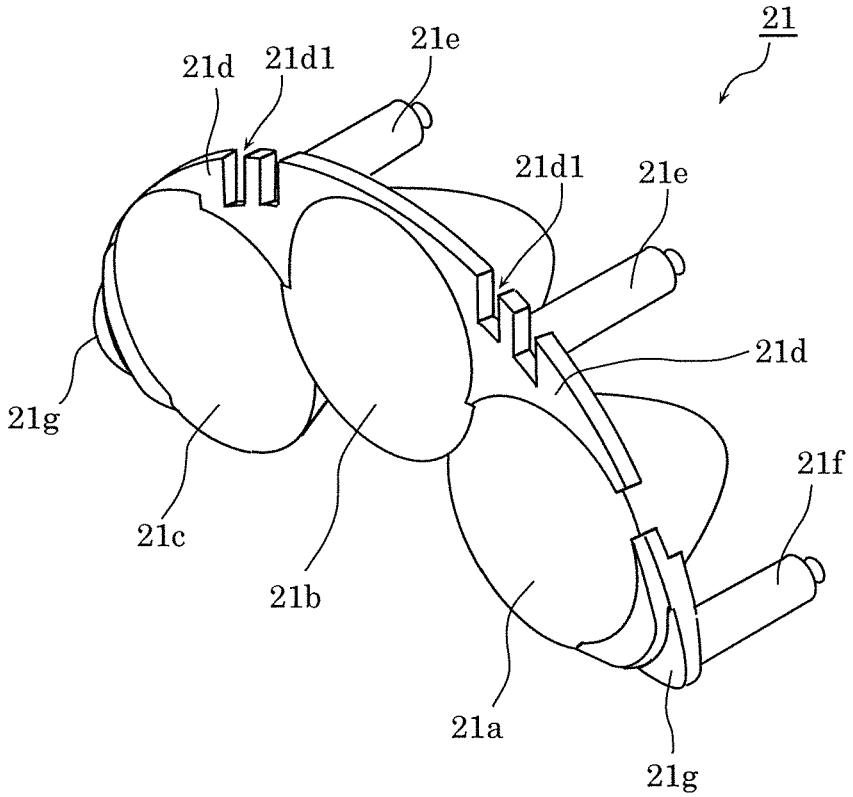
FIG. 22 is a perspective view of a high beam lens unit included in a lighting apparatus according to one example of the present invention.
Figure 23:
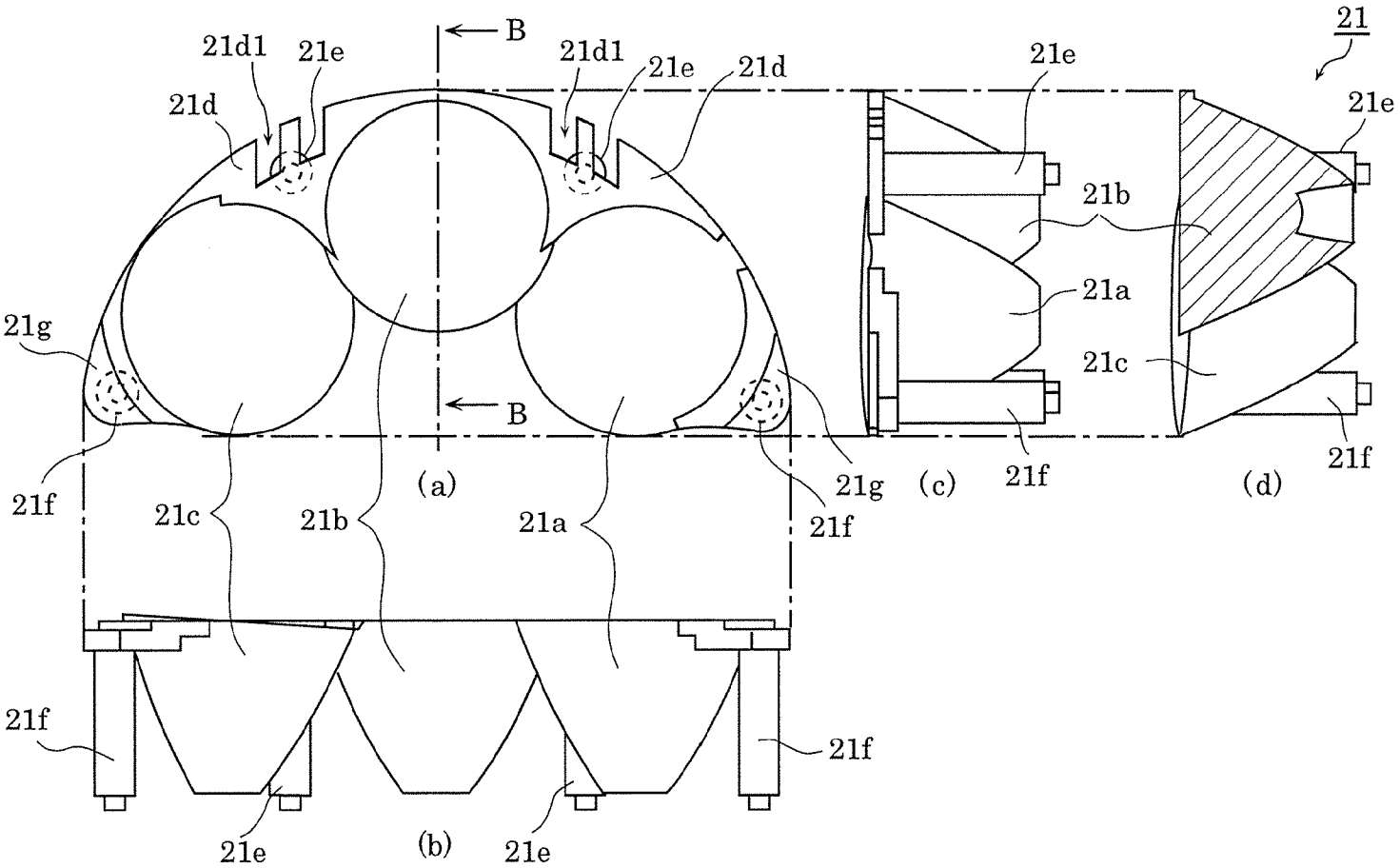
FIG. 23 illustrates the structure of a high beam lens unit included in a lighting apparatus according to one example of the present invention, where (a) illustrates a front view, (b) illustrates a bottom view, (c) illustrates a side view, and (d) illustrates a cross sectional view taken at the line B-B in (a)
Figure 24:
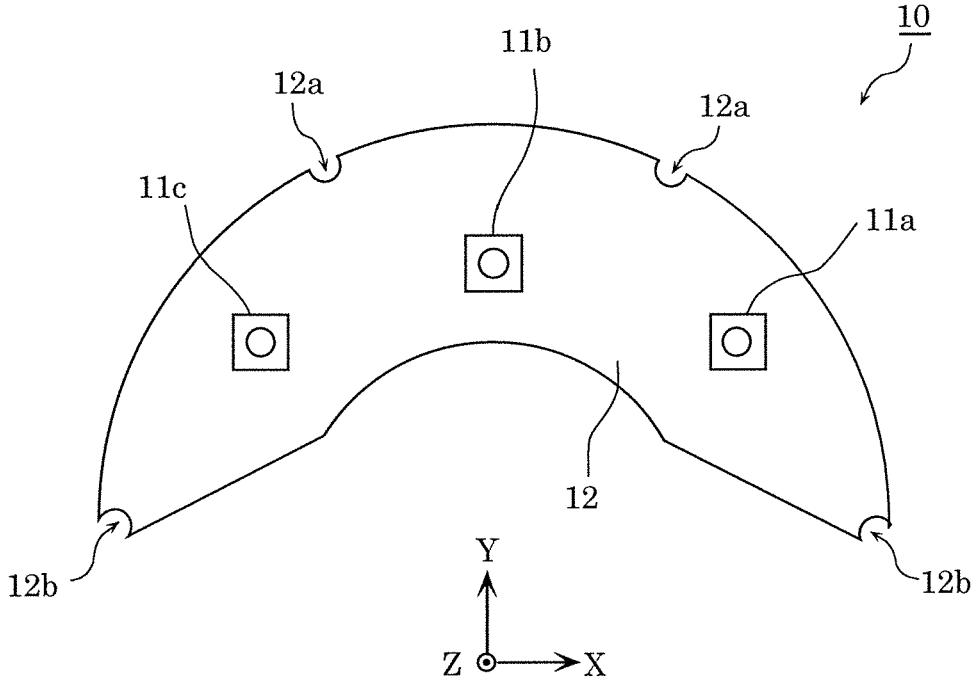
FIG. 24 is a front view of a high beam light source module included in a lighting apparatus according to one example of the present invention.

Next, the configuration of high beam lens unit 21 and high beam light source module 10 will be described in detail with reference to FIG. 22 through FIG. 24. FIG. 22 is a perspective view of the high beam lens unit included in the lighting apparatus according to the third embodiment. FIG. 23 illustrates the structure the high beam lens unit included in the lighting apparatus according to the third embodiment. In FIG. 23, (a) illustrates a front view, (b) illustrates a bottom view, (c) illustrates a side view, and (d) illustrates a cross sectional view taken at the line B-B in (a). FIG. 24 is a front view of the high beam light source module included in the lighting apparatus according to the third embodiment.

As illustrated in FIG. 22 and FIG. 23, high beam lens unit (first optical component) 21 includes a plurality of lenses (first collimating lens 21*a*, first collimating lens 21*b*, and second collimating lens 21*c*), connecting portion 21*d* that connects adjacent lenses, substrate retainer 21*e*, substrate retainer 21*f*, and extension 21*g*.

High beam lens unit 21 can be integrally molded from a transparent resin material. In this case, first collimating lens 21*a*, first collimating lens 21*b*, second collimating lens 21*c*, connecting portion 21*d*, substrate retainer 21*e*, substrate retainer 21*f*, and extension 21*g* are integrally formed as a single component.

Moreover, in the third embodiment, since high beam lens unit 21 includes three collimating lenses, high beam lens unit includes two connecting portions 21*d*. More specifically, high beam lens unit 21 includes one connecting portion 21*d* connecting first collimating lens 21*a* and first collimating lens 21*b*, and one connecting portion 21*d* connecting first collimating lens 21*b* and second collimating lens 21*c*.

Connecting portions 21*d* are formed so as to fill in the gap between the two adjacent lenses. Connecting portion 21*d* is, for example, a plate having a substantially arc-shaped outer edge in a front view of lighting apparatus 1. In a front view of the plate, the outer perimeter of the plate is defined by a portion of the outer edges of two adjacent collimating lenses in high beam lens unit 21 and the arc-shaped outer edge described above. In the third embodiment, connecting portion 21*d* is substantially fan-shaped in front view.

Note that high beam lens unit 21 may be formed such that each outer edge of first collimating lens 21*a*, first collimating lens 21*b*, and second collimating lens 21*c* is inscribed in the substantially arc-shaped boundary of connecting portion 21*d*.

Connecting portion 21*d* includes notches 21*d*1. Notches 21*d*1 are cut out from the curved top edge of connecting portion 21*d*. Protrusions 31*d* protruding from heat sink 30 (first heat sink 31) are inserted into notches 21*d*1.

Substrate retainers 21*e* (first substrate retainers) are disposed on connecting portion 21*d* and formed so as to protrude from connecting portion 21*d* toward substrate 12 of high beam light source module 10. In the third embodiment, substrate retainers 21*e* are, for example, cylindrical columns. Moreover, one substrate retainer 21*e* is formed on each of the two connecting portions 21*d*.

Substrate retainers 21*f* (second substrate retainers) are disposed on extension 21*g* and formed so as to protrude from extension 21*g* toward substrate 12 of high beam light source module 10. In the third embodiment, substrate retainers 21*f* are, for example, cylindrical columns. Moreover, one substrate retainer 21*f* is formed on each of the two extensions 21*g*.

The four substrate retainers 21*e* and 21*f* are disposed in positions that do not overlap with the plurality of lenses included in high beam lens unit 21 (first collimating lens 21*a*, first collimating lens 21*b*, and second collimating lens 21*c*) in front view.

In the third embodiment, the two substrate retainers 21*e* are disposed in a region within a line enveloping the outer edges of the plurality of lenses included in high beam lens unit 21 (first collimating lens 21*a*, first collimating lens 21*b*, and second collimating lens 21*c*) in front view.

More specifically, each substrate retainer 21*e* is disposed within the region of connecting portion 21*d* (substantial fan shape) in plan view. Furthermore, each substrate retainer 21*e* is disposed substantially equidistant from the outer edges of two adjacent lenses in plan view. Note that "substantially equidistant" does not exclusively refer to actual substantial equidistance, but also includes substantial equidistance in design, and is a general concept intended to include a margin of error to account for, for example, production tolerance. Each substrate retainer 21*f* is disposed within the region of extension 21*g* in plan view.

Substrate retainers 21*e* and substrate retainers 21*f* have the same shape and length, and a recessed portion is formed in the tip of each of substrate retainers 21*e* and substrate retainers 21*f*. More specifically, cylindrical columns (small diameter portions) smaller in diameter than the main cylindrical columns of substrate retainers 21*e* and substrate retainers 21*f* are formed on the tips of substrate retainers 21*e* and substrate retainers 21*f*. In other words, the tips of substrate retainers 21*e* and substrate retainers 21*f* have a stepped surface such that a recessed surface is formed one step down from the tip surface.

Extensions 21*g* extend outward (i.e., in the X axis direction) from the outer positioned ones of the plurality of lenses. Extensions 21*g* are formed on the right and left peripheries of high beam lens unit 21 in a front view.

As illustrated in FIG. 24, high beam light source module 10 includes three high beam light emitting devices 11 (first high beam light emitting device 11*a*, high beam light emitting device 11*b*, and second high beam light emitting device 11*c*), and substrate 12. Substrate 12 is, for example, substantially fan-shaped. Moreover, in front view, the shape of the outline (profile) of substrate 12 included in high beam light source module 10 is substantially the same as the shape of the outline (profile of high beam lens unit 21.

Two notches 12*a* are cut out of the top edge of the arc shape of substrate 12. Additionally, notch 12*b* is cut out of the right edge of substrate 12, and notch 12*b* is cut out of the left edge of substrate 12. Notches 12*a* are located in positions corresponding to substrate retainers 21*e* formed on high beam lens unit 21. Notches 12*b* are located in positions corresponding to substrate retainers 21*f* formed on high beam lens unit 21.

Figure 25:
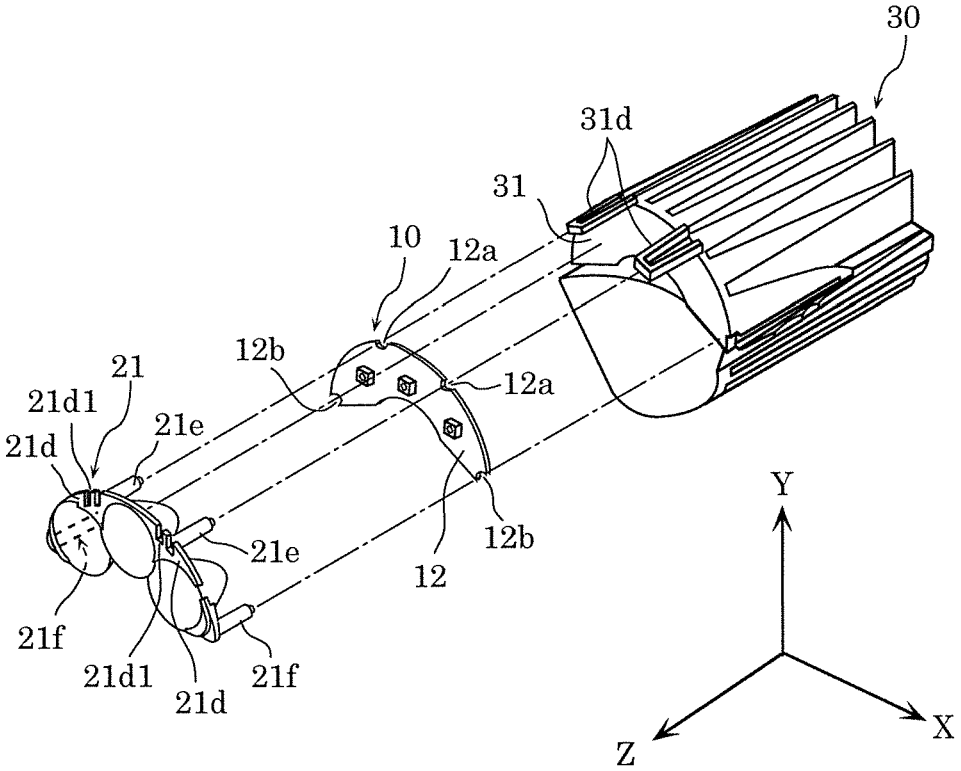
FIG. 25 illustrates how a high beam lens unit, a high beam light source module, and a heat sink are assembled in a lighting apparatus according to one example of the present invention.

Next, how high beam lens unit 21, high beam light source module 10, and heat sink 30 are connected together will be described with reference to FIG. 25. FIG. 25 illustrates how the high beam lens unit, the high beam light source module, and the heat sink are assembled in the lighting apparatus according to the third embodiment.

As illustrated in FIG. 25, high beam light source module 10 is positioned between high beam lens unit 21 and heat sink 30. High beam lens unit 21, high beam light source module 10, and heat sink 30 are arranged such that high beam lens substrate retainers 21*e* formed on high beam lens unit 21 are correspond with notches 12*a* cut out of substrate 12 and substrate retainers 21*f* formed on high beam lens unit 21 correspond with notches 12*b* cut out of substrate 12. Thus, high beam lens unit 21 and heat sink 30 support high beam light source module 10.

With this configuration, high beam light source module 10 is held down onto heat sink 30 by high beam lens unit 21. More specifically, substrate 12 included in high beam light source module 10 is held down onto first heat sink 31 by substrate retainers 21*e* and substrate retainers 21*f* formed on high beam lens unit 21.

Note that in this case, high beam lens unit 21 is held down by another holding member (not shown in the drawings) from the front. This holding member may be, for example, a screw.

Moreover, in the third embodiment, protrusions 31*d* formed on first heat sink 31 are inserted into notches 21*d*1 cut into connecting portion 21*d* of high beam lens unit 21. In other words, protrusions 31*d* are lens holding members, and hold the top portion of connecting portion 21*d*. In this way, high beam lens unit 21 is also held in place by protrusion 31*d*.

Figure 26:
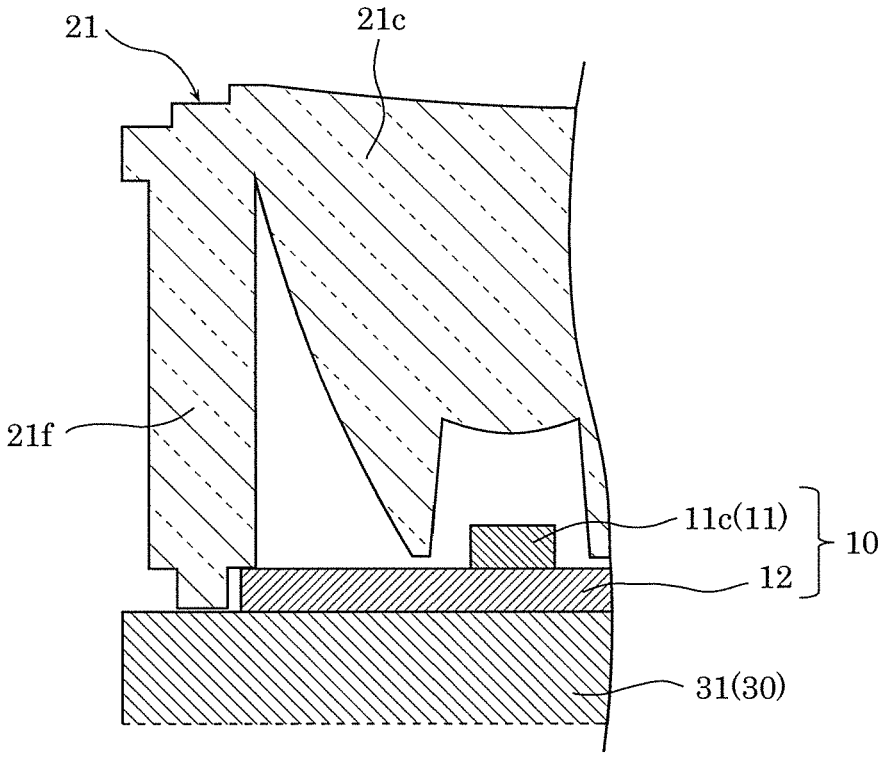
FIG. 26 is an enlarged cross sectional view of a lighting apparatus according to one example of the present invention taken at line X-X in FIG. 18.

FIG. 26 illustrates how high beam light source module 10 is held down by high beam lens unit 21. FIG. 26 is a cross sectional view taken at line X-X in FIG. 18.

As illustrated in FIG. 26, high beam light source module 10 is held in place on heat sink 30 by substrate retainer 21*f* holding down substrate 12. More specifically, high beam lens unit 21 is pressed down from the front toward the back such that the small diameter portion of the tip of substrate retainer 21*f* is inserted into notch 12*b* cut out of substrate 12.

Here, the stepped surface (recessed surface) of the tip of substrate retainer 21*f* engages with the front surface of substrate 12. As such, substrate 12 is held down on first heat sink 31 by a pressing force applied by the stepped surface of the tip of substrate retainer 21*f*. Consequently, high beam lens unit 21 and high beam light source module 10 can be accurately aligned.

Moreover, the side surface of small diameter portion and the inner surface of notch 12*b* come into contact when the small diameter portion of the tip of substrate retainer 21*f* is inserted into notch 12*b* cut out of substrate 12. This makes it possible to restrict horizontal (XY plane) movement of high beam lens unit 21, thereby making it possible to even more accurately align high beam lens unit 21 and high beam light source module 10 with ease.

Although not illustrated in FIG. 26, note that the same applies to substrate retainers 21*e* formed on connecting portion 21*d*. In other words, when high beam lens unit 21 is pressed in place from the front toward the back, the small diameter portion of the tip of substrate retainer 21*e* is inserted into notch 12*a* cut out of substrate 12. Here, similar to substrate retainer 21*f*, the stepped surface (recessed surface) of the tip of substrate retainer 21*e* engages with the front surface of substrate 12. As such, substrate 12 is held down on first heat sink 31 by a pressing force applied by the stepped surfaces of the tips of substrate retainers 21*e* and substrate retainers 21*f*.

As described above, with lighting apparatus 1 according to the third embodiment, substrate 12 included in high beam light source module 10 is pressed onto base 2 by substrate retainers 21*e* and substrate retainers 21*f* formed on high beam lens unit 21. In the third embodiment, substrate 12 included in high beam light source module 10 is pressed onto heat sink 30 (first heat sink 31) by substrate retainers 21*e* and substrate retainers 21*f*.

This makes it easy to align high beam lens unit 21 and high beam light source module 10.

Moreover, in the third embodiment, substrate retainers 21*e* and substrate retainers 21*f* are disposed in positions that do not overlap with the plurality of lenses included in high beam lens unit 21 (first collimating lens 21*a*, first collimating lens 21*b*, and second collimating lens 21*c*), in a front view of lighting apparatus 1.

With this, substrate retainers 21*e* and substrate retainers 21*f* can be formed without affecting the plurality of lenses included in high beam lens unit 21 (first collimating lens 21*a*, first collimating lens 21*b*, and second collimating lens 21*c*). Consequently, even when substrate retainers 21*e* and substrate retainers 21*f* are formed, the anteroposterior length of high beam lens unit 21 can be kept from being too long, making it possible to reduce the overall size of lighting apparatus 1.

In this way, with lighting apparatus 1 and automobile 100 according to the third embodiment, high beam lens unit 21 and high beam light source module 10 can be accurately aligned and the size of lighting apparatus 1 can be reduced.

Moreover, in the third embodiment, substrate retainers 21*e* are disposed on connecting portion 21*d* and protrude from connecting portion 21*d* toward substrate 12 of high beam light source module 10.

With this, by applying a pressing force in a backward direction on high beam lens unit 21, substrate 12 also receives this backward pressing force from substrate retainers 21*e* and substrate retainers 21*f*, and is consequently held in place. This allows for high beam light source module 10 to be easily and securely held in place.

Moreover, in the third embodiment, connecting portion 21*d* of high beam lens unit 21 is substantially fan-shaped in front view, and substrate retainer 21*e* is disposed within the fan-shaped region in front view.

This makes it possible to arrange lighting apparatus so as to fit in a given circular region (e.g., a $\phi$70 mm region) in front view.

Moreover, in the third embodiment, heat sink 30 of base 2 includes protrusions 31*d* as a lens holding member. Protrusions 31*d* hold the top portion of connecting portion 21*d*.

This makes it possible to easily hold high beam lens unit 21 in place.

Moreover, in the third embodiment, each substrate retainer 21*e* is disposed substantially equidistant from the outer edges of two adjacent lenses among the plurality of lenses (first collimating lens 21*a*, first collimating lens 21*b*, and second collimating lens 21*c*) in plan view.

When substrate retainer 21*e* is made from resin, pressing down on substrate 12 places stress on substrate retainers 21*e*, which can lead to substrate retainers 21*e* breaking, for example. However, by disposing each substrate retainer 21*e* is substantially equidistant from the outer edges of two adjacent lenses, stress placed on substrate retainers 21*e* from pressing down on substrate 12 can be equally distributed. This makes it possible to control, for example, breakage of substrate retainers 21*e*.

Moreover, in the third embodiment, substrate retainers 21*f* are formed on extensions 21*g* extending from both ends of high beam lens unit 21.

This makes it possible to securely hold substrate 12 included in high beam light source module 10 in place since both ends of substrate 12 are held down.

Moreover, in the third embodiment, heat sink 30 may include holding members that hold extensions 21*g* of high beam lens unit 21. In this case, substrate retainers 21*e* and substrate retainers 21*f* formed on high beam lens unit 21 may have a thermal expansion coefficient (linear expansion coefficient) that is greater than the thermal expansion coefficient (linear expansion coefficient) of the holding members. For example, the holding members may be made of metal, and substrate retainers 21*e* may be made from resin. With this, extensions 21*g* are pinched by the holding members when substrate retainers 21*e* thermally expand due the heat generated by high beam light emitting device 11 when the high beams are used. As a result, the pressing force on substrate 12 by substrate retainer 21*e* increases and substrate 12 can be held in place even more securely.

Summary of Third Embodiment

As described above, lighting apparatus 1 according to the third embodiment is for vehicle use, projects light forward, and includes: base 2; first light source module 10 disposed on base 2; second light source module 13 disposed on base 2; a first optical component (first lens body 21) disposed in front of first light source module 10; and a second optical component (second lens body 22) disposed in front of second light source module 13, wherein first light source module 10 includes substrate 12 and a plurality of first light emitting devices 11 mounted on substrate 12, the first optical component (first lens body 21) includes a plurality of lenses (for example, first collimating lens 21*a*, first collimating lens 21*b*, and second collimating lens 21*c*) disposed in front of the plurality of first light emitting devices 11 in a one-to-one relationship, substrate 12 is held down onto base 2 by substrate retainers 21*e*, 21*f*, and substrate retainers 21*e*, 21*f* are disposed in a position that does not overlap with the plurality of lenses in a front view of lighting apparatus 1.

This makes it possible to control the positioning of the light emitting devices and the lenses and thus accurately align the light emitting devices and the lenses.

Here, base 2 may include heat sink 30, and substrate 12 may be held down onto heat sink 30 by substrate retainers 21*e*, 21*f*.

Here, heat sink 30 may include first heat sink 31 to which first light source module 10 is fixed and second heat sink 32 to which second light source module 13 is fixed, and substrate 12 may be held down onto first heat sink 31 by substrate retainers 21*e*, 21*f*.

Here, the first optical component (first lens body 21) may include connecting portion 21*d* that connects adjacent ones of the plurality of lenses (first collimating lens 21*a*, first collimating lens 21*b*, and second collimating lens 21*c*), and substrate retainers 21*e*, 21*f* may be disposed on connecting portion 21*d* and protrude toward substrate 12.

Here, connecting portion 21*d* may be a plate having a substantially arc-shaped outer edge in a front view of lighting apparatus 1, and an outer perimeter of the plate in a front view of lighting apparatus 1 may be defined by a portion of an outer edge of the adjacent ones of the plurality of lenses (first collimating lens 21*a*, first collimating lens 21*b*, and second collimating lens 21*c*) and the substantially arc-shaped outer edge.

Here, connecting portion 21*d* may be substantially fan-shaped in front view, and substrate retainers 21*e*, 21*f* may be disposed within the fan-shaped region in a front view of lighting apparatus 1.

Here, base 2 may include a lens holding member (protrusion 31*d*) and the lens holding member (protrusion 31*d*) may hold a top portion of connecting portion 21*d*.

Here, substrate retainers 21*e*, 21*f* may be disposed substantially equidistant from the outer edges of two adjacent lenses (first collimating lens 21*a*, first collimating lens 21*b*, and second collimating lens 21*c*) in a plan view of lighting apparatus 1.

Here, the first optical component (first lens body 21) may include extension 21*g* that extends outward from the outer positioned ones of the plurality of lenses (first collimating lens 21*a*, first collimating lens 21*b*, and second collimating lens 21*c*), and substrate retainers 21*e*, 21*f* may be disposed on extension 21*g*.

Here, heat sink 30 may include a holding member that holds extension 21*g*, and substrate retainers 21*e*, 21*f* may have a thermal expansion coefficient that is greater than the thermal expansion coefficient of the holding member.

Here, lighting apparatus 1 may further include shield 40 that shields a portion of light from at least one of first light source module 10 and second light source module 13, and substrate retainers 21*e*, 21*f* may be disposed on shield 40.

Here, one of first light source module 10 and second light source module 13 may be a high beam light source module, and the remaining one of first light source module 10 and second light source module 13 may be a low beam light source module.

Moreover, automobile 100 according to the third embodiment includes the above-described lighting apparatus 1, and vehicle body 110 including lighting apparatus 1 disposed in front.

Other Variations

Although the lighting apparatus, automobile, etc. according to the present disclosure are described based on embodiments, the present disclosure is not limited to these embodiments.

For example, in the above embodiments, substrate retainers 21*e* and substrate retainers 21*f* are disposed on high beam lens unit 21, but may be disposed in other locations so long as those locations do not overlap with first collimating lens 21*a*, first collimating lens 21*b*, and second collimating lens 21*c*. For example, substrate retainers 21*e* and substrate retainers 21*f* may be disposed on shield 40.

Moreover, in the above embodiments, substrate 12 of high beam light source module 10 is held onto heat sink 30 using substrate retainers 21*e* and substrate retainers 21*f* of high beam lens unit 21, but substrate 15 of low beam light source module 13 may also be held onto heat sink 30 based on the same principle. In this case, a desired structural element disposed on lighting apparatus 1 may be used as the substrate retainer.

Moreover, in the above embodiments, heat sink 30 is divided into two components—and upper component and a lower component—but heat sink 30 is not limited to this configuration. For example, heat sink 30 may be divided into a left component and a right component.

Fourth Embodiment

In the fourth embodiment, a lighting apparatus and automobile with which both optical alignment and thermal efficiency can be achieved for two light emitting devices without compromising the ease of assembly of the lighting apparatus, even when a heat sink for dissipating the heat generated by the two light emitting devices is used, will be described.

Generally, an LED generates heat when it outputs light. This heat increases the temperature of the LED, decreasing the light output of the LED. For this reason, lighting apparatuses generally include a heat sink to dissipate the heat generated by the LED.

However, vehicle lighting apparatuses include two light emitting devices (light sources)—a low beam light emitting device and a high beam light emitting device. This makes it difficult to include a heat sink while achieving both optical alignment and thermal efficiency for two light emitting devices without compromising the ease of assembly of other components in the lighting apparatus.

In order to overcome this, according to one aspect of the present disclosure, a lighting apparatus for vehicle use that projects light forward is provided. The lighting apparatus includes: a base including a heat sink; a first light emitting device disposed on the base; a second light emitting device disposed on the base; and a lens body disposed in front of the first light emitting device and the second light emitting device, wherein the heat sink includes a first heat sink thermally coupled to the first light emitting device and a second heat sink thermally coupled to the second light emitting device, and the first heat sink and the second heat sink are adjoined in a direction intersecting the anteroposterior direction.

This makes it possible to provide a lighting apparatus and automobile which achieve both optical alignment and thermal efficiency for two light emitting devices without compromising the ease of assembly of the lighting apparatus.

The external view of automobile 100 according to the fourth embodiment is the same as illustrated in FIG. 1 and previously described.

Lighting Apparatus

The perspective, front, top, cross sectional views as well as the light paths of lighting apparatus 1 according to the fourth embodiment are the same as illustrated in FIG. 2 through FIG. 6 and previously described.

Moreover, details regarding structural elements such as high beam light source module 10, low beam light source module 13, high beam lens unit (first lens body) 21, low beam lens unit (second lens body) 22, heat sink 30, shield 40, etc., are the same as previously described.

On/Off Control

The block diagram illustrated FIG. 21 also applies to the configuration relating to lighting functions of the automobile according to the fourth embodiment. In other words, FIG. 21 is an illustration of when lighting apparatus 1 according to the fourth embodiment is installed in automobile 100.

Heat Sink Configuration

Figure 27:
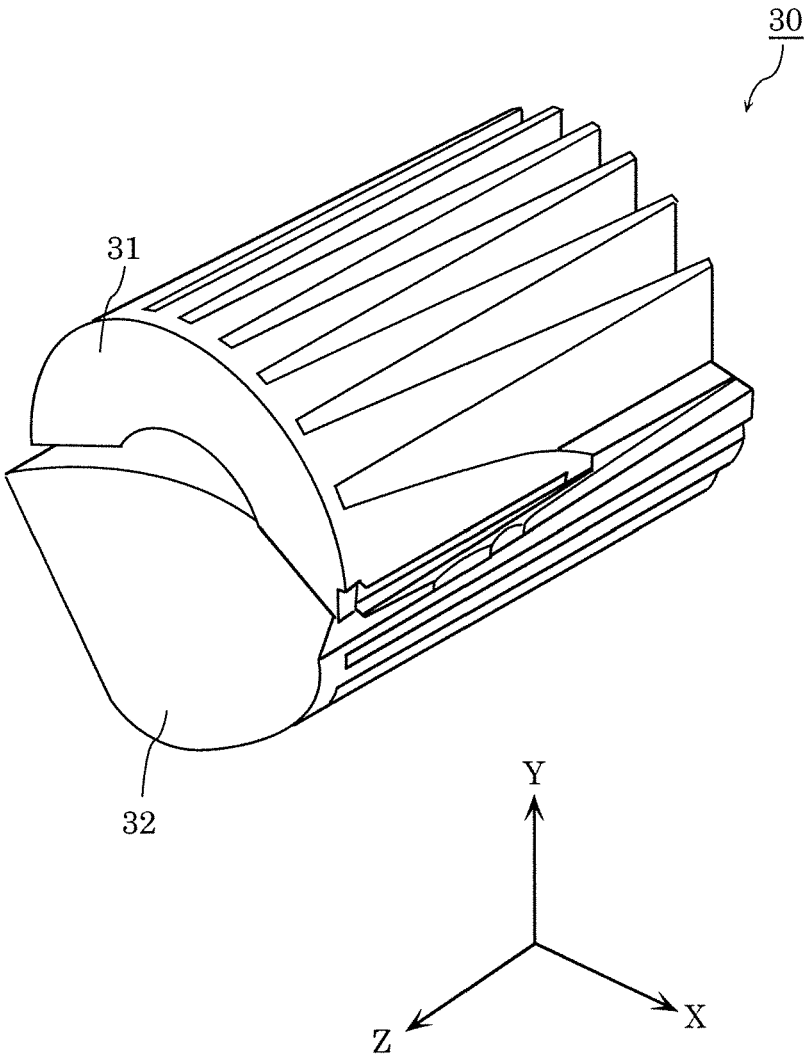
FIG. 27 is a perspective view of a heat sink included in a lighting apparatus according to one example of the present invention.
Figure 28:
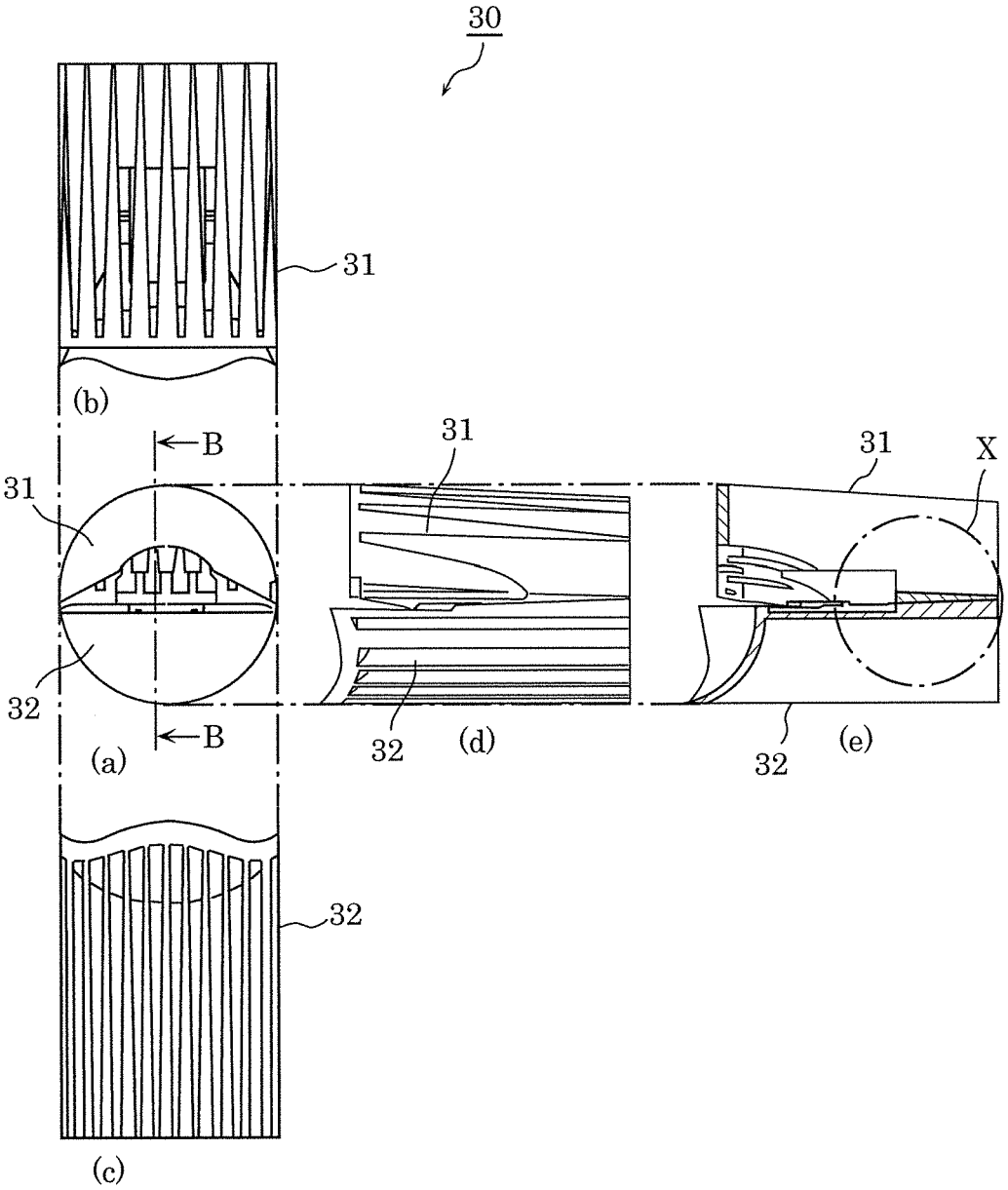
FIG. 28 illustrates the configuration of a heat sink included in a lighting apparatus according to one example of the present invention, where (a) illustrates a front view, (b) illustrates a top view, (c) illustrates a bottom view, (d) illustrates a side view, and (e) illustrates a cross sectional view taken at line B-B in (a)
Figure 29:
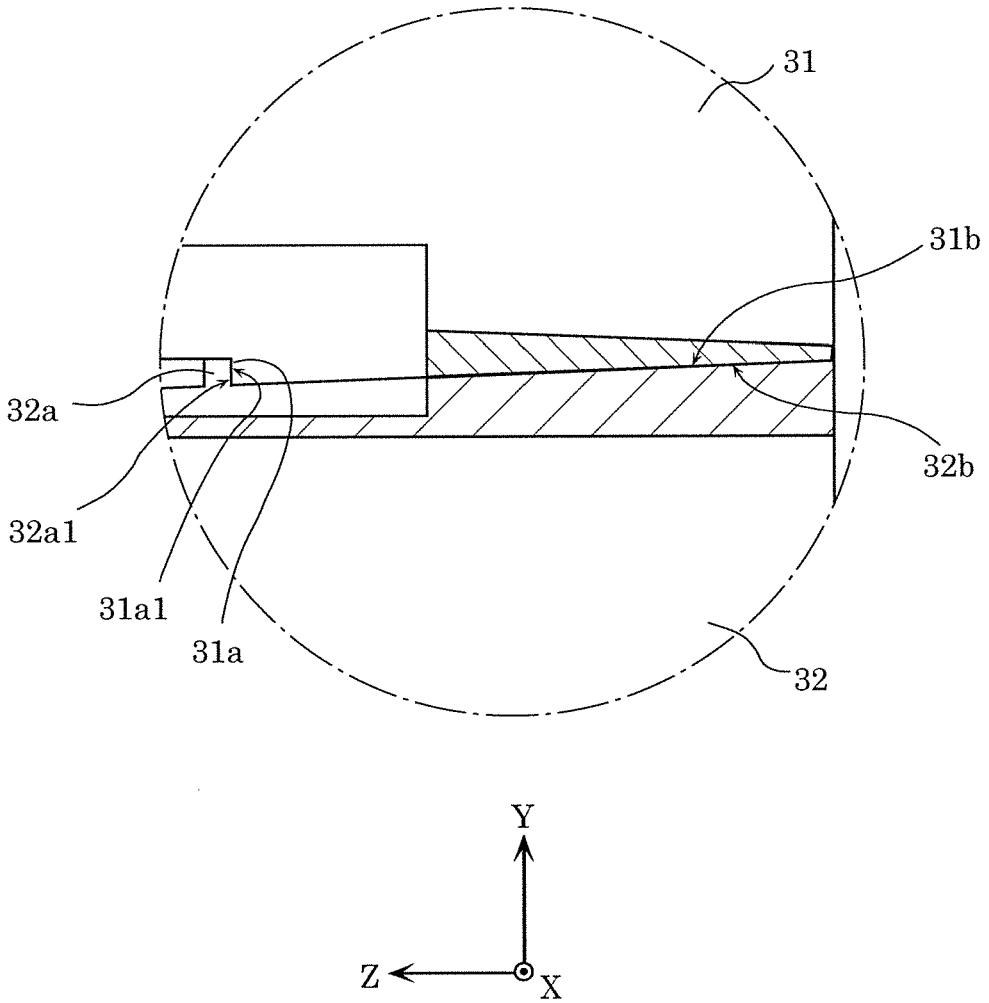
FIG. 29 is an enlarged view of region X outlined with a dotted-and-dashed line in (e) in FIG. 28.

Next, heat sink 30 will be described in detail with reference to FIG. 27 through FIG. 29. FIG. 27 is a perspective view of the heat sink included in the lighting apparatus according to the fourth embodiment. FIG. 28 illustrates the same heat sink. In FIG. 28, (a) illustrates a front view, (b) illustrates a top view, (c) illustrates a bottom view, (d) illustrates a side view, and (e) illustrates a cross sectional view taken at line B-B in (a). FIG. 29 is an enlarged view of region X outlined with a dotted-and-dashed line in (e) in FIG. 28.

As illustrated in FIG. 27 and FIG. 28, heat sink 30 is divided into two components—first heat sink 31 and second heat sink 32. In the fourth embodiment, heat sink 30 is divided into two components that are adjacent in a direction intersecting the anteroposterior direction, and first heat sink 31 and second heat sink 32 are adjoined in a direction intersecting the anteroposterior direction. More specifically, heat sink 30 is divided into an upper component and a lower component (i.e., divided into two components stacked in the Y axis direction). In other words, first heat sink 31 and second heat sink 32 are stacked vertically (in the Y axis direction) so as to be adjacent in the Y axis direction.

Moreover, heat sink 30 includes a rotation restricting structure that restricts rotational movement of first heat sink 31 and second heat sink 32. Rotational movement of first heat sink 31 and second heat sink 32 is, for example, rotational movement of one or both of first heat sink 31 and second heat sink 32 in the XZ plane (horizontal plane) that results in a misalignment between first heat sink 31 and second heat sink 32, or rotational movement of one or both of first heat sink 31 and second heat sink 32 about the Z axis that results in a misalignment between first heat sink 31 and second heat sink 32.

As illustrated in FIG. 29, in the fourth embodiment, the rotation restricting structure includes recessed portion 31*a* and protruding portion 32*a*. Recessed portion 31*a* is formed in first heat sink 31. More specifically, recessed portion 31*a* is formed in the portion facing second heat sink 32. Protruding portion 32*a* is formed in second heat sink 32. More specifically, protruding portion 32*a* is formed in the portion facing first heat sink 31. Note that recessed portion 31*a* and protruding portion 32*a* are also anteroposterior movement restricting structures that restrict anteroposterior movement of first heat sink 31 and second heat sink 32.

Recessed portion 31*a* is formed in first heat sink 31 so as to recede away from second heat sink 32. Moreover, recessed portion 31*a* includes planar side surface 31*a*1 facing the anteroposterior direction.

In the fourth embodiment, planar side surface 31*a*1 is parallel to the XY plane, and extends along the X axis. In front view, planar side surface 31*a*1 has, for example, an elongated rectangular shape that is horizontally long.

Protruding portion 32*a* is formed on second heat sink 32 so as to protrude toward first heat sink 31. Protruding portion 32*a* includes a planar side surface (planar wall) 32*a*1 facing the anteroposterior direction. The cross sectional shape of planar side surface 32*a*1 through the ZX plane is rectangular.

In the fourth embodiment, protruding portion 32*a* is a laterally extending (i.e., extends along the X axis) elongated protrusion. Planar side surface 32*a*1 is thus parallel to the XY plane, and extends laterally (along the X axis). In front view, planar side surface 32*a*1 has, for example, an elongated rectangular shape that is horizontally long.

Moreover, a plurality of protruding portions 32*a* are formed. More specifically, two protruding portions 32*a* are disposed so as to be spaced apart from each other and have a lengthwise dimension along the X axis. In this example, the two protruding portions 32*a* are formed such that planar side surfaces 32*a*1 thereof are flush.

Moreover, in the fourth embodiment, the adjoining portions of first heat sink 31 and second heat sink 32 (i.e., the surfaces of first heat sink 31 and second heat sink 32 that are in contact) are sloping surfaces. In other words, sloping surface 31*b* formed on first heat sink 31 and sloping surface 32*b* formed on second heat sink 32 are in contact.

Sloping surface 31*b* of first heat sink 31 and sloping surface 32*b* of second heat sink 32 slope forward (the direction in which light is extracted). In other words, the distance between sloping surface 31*b* of first heat sink 31 and the Z axis as illustrated in FIG. 29, as well as between sloping surface 32*b* of second heat sink 32 and the Z axis as illustrated in FIG. 29, decreases toward the front (in other words, the distance in the vertical direction decreases toward the front).

Recessed portion 31*a* of first heat sink 31 is formed at an end portion of the slope of sloping surface 31*b* of first heat sink 31. In other words, recessed portion 31*a* is formed so as to recede at the forward terminal end portion of sloping surface 31*b*.

Moreover, protruding portion 32*a* of second heat sink 32 is formed at an end portion of the slope of sloping surface 32*b* of second heat sink 32. In other words, protruding portion 32*a* is formed at the forward terminal end portion of sloping surface 32*b*.

First heat sink 31 and second heat sink 32 having the hereinbefore described configurations are assembled by bringing recessed portion 31*a* and protruding portion 32*a* into contact. More specifically, when first heat sink 31 and second heat sink 32 are in an assembled state, planar side surface 31*a*1 of recessed portion 31*a* and planar side surface 32*a*1 of protruding portion 32*a* are in contact. Note that in the fourth embodiment, the depth of recessed portion 31*a* and the height of protruding portion 32*a* are, but not limited to being, approximately equal.

Figure 30:
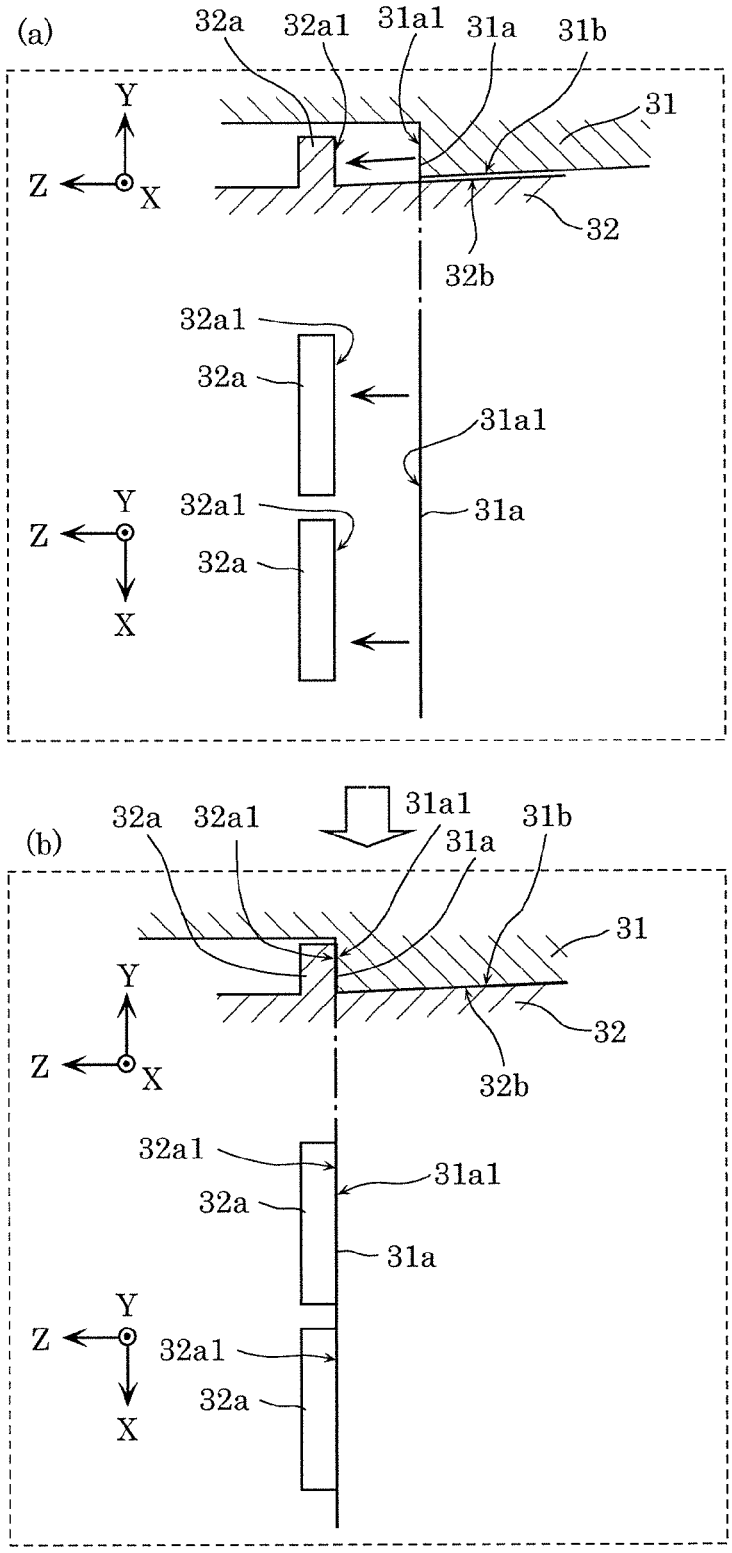
FIG. 30 illustrates a first heat sink and a second heat sink included in a lighting apparatus according to one example of the present invention, upon assembling together the first heat sink and the second heat sink.

Next, the method of putting together first heat sink 31 and second heat sink 32 will be described with reference to FIG. 30. FIG. 30 illustrates the first heat sink and the second heat sink included in the lighting apparatus according to the fourth embodiment upon assembling together the first heat sink and the second heat sink.

As illustrated in (a) in FIG. 30, upon assembling together first heat sink 31 and second heat sink 32, first heat sink 31 and second heat sink 32 are slid along the Z axis while sloping surface 31*b* of first heat sink 31 and sloping surface 32*b* of second heat sink 32 are in contact.

Here, first heat sink 31 and second heat sink 32 are slid so as to bring recessed portion 31*a* of first heat sink 31 and protruding portion 32*a* of second heat sink 32 closer together.

Moreover, as illustrated in (b) in FIG. 30, first heat sink 31 and second heat sink 32 are slid until recessed portion 31*a* of first heat sink 31 and protruding portion 32*a* of second heat sink 32 are brought into contact. Moreover, as illustrated in (b) in FIG. 30, first heat sink 31 and second heat sink 32 are slid until recessed portion 31*a* of first heat sink 31 and protruding portion 32*a* of second heat sink 32 are brought into contact. As a result, planar side surface 31*a*1 of recessed portion 31*a* and planar side surface 32*a*1 and protruding portion 32*a* are in contact. This makes it possible to position first heat sink 31 and second heat sink 32 with respect to the anteroposterior direction (Z axis direction).

Main Functional Effect

Next, the functional effect of lighting apparatus 1 according to the fourth embodiment will be described.

As described above, heat sink 30 in lighting apparatus 1 includes first heat sink 31 (high beam heat sink) thermally coupled to high beam light emitting device 11 (first light emitting device) and second heat sink 32 (low beam heat sink) thermally coupled to low beam light emitting device 14 (second light emitting device). First heat sink 31 and second heat sink 32 are adjoined in a direction intersecting the anteroposterior direction.

Therefore, by dividing heat sink 30 into first heat sink 31 and second heat sink 32 and assembling the two together, the portions where first heat sink 31 and second heat sink 32 are connected (i.e., the surfaces of first heat sink 31 and second heat sink 32 that are in contact) or a layer of air between first heat sink 31 second heat sink become resistant to heat. With this, the heat dissipation paths for high beam light emitting device 11 and low beam light emitting device 14 are separated. Consequently, with respect to high beam light emitting device 11 and low beam light emitting device 14, the effect heat generated by one has on the other is reduced.

In particular, in the fourth embodiment, all light emitting devices are turned on when the low beams are turned on, and the heat generated by high beam light source module 10 is greater than the heat generated by low beam light source module 13. Thus, in the fourth embodiment, by separating the heat dissipation paths for high beam light emitting device 11 and low beam light emitting device 14, a decrease in the output of low beam light source module 13 (low beam light emitting device 14) caused by the heat generated by high beam light source module 10 (high beam light emitting device 11) can be, for example, reduced.

Note that in the fourth embodiment, the portions where first heat sink 31 and second heat sink 32 are connected (i.e., the surfaces of first heat sink 31 and second heat sink 32 that are in contact) are in the rear portion of heat sink 30, positioned far away from high beam light emitting device 11 and low beam light emitting device 14. Consequently, with respect to high beam light emitting device 11 and low beam light emitting device 14, the effect heat generated by one has on the other is further reduced.

Moreover, such as is the case with the fourth embodiment, heat sink 30 can be manufactured with ease by dividing heat sink 30 into a plurality of components. Furthermore, since dividing heat sink 30 into a plurality of components increases flexibility with respect to assembly (design flexibility), it is possible to manufacture multiple types of heat sink 30 each suited to a particular product destination. Furthermore, dividing heat sink 30 into a plurality of components makes routing power supply connector wires connected to each of high beam light source module 10 and low beam light source module 13 easier, making assembly of lighting apparatus 1 easier.

Furthermore, dividing heat sink 30 into a high beam heat sink (first heat sink 31) and a low beam heat sink (second heat sink 32) makes it possible to thermally design high beam light emitting device 11 and low beam light emitting device 14 individually. In other words, flexibility with respect to thermal design is increased.

Moreover, in the fourth embodiment, high beam light emitting device 11 is fixed to first heat sink 31 and low beam light emitting device 14 is fixed to second heat sink 32.

With this, the vector of the optical axis (high beam optical axis) of high beam light emitting device 11 can be controlled with the positioning and orientation of first heat sink 31, and the vector of the optical axis (low beam optical axis) of low beam light emitting device 14 can be controlled with the positioning and orientation of second heat sink 32.

Therefore, optical alignment of high beam lamp 3 including high beam light emitting device 11 and optical alignment of low beam lamp 4 including low beam light emitting device 14 can be accomplished simply by assembling together first heat sink 31 and second heat sink 32 in addition to allowing for individual thermal design of high beam light emitting device 11 and low beam light emitting device 14.

The optical axis of high beam lamp 3 and the optical axis of low beam lamp 4 may be aligned when performing optical alignment. For example, the vector of the optical axis of high beam lamp 3 and the vector of the optical axis of low beam lamp 4 may be made to be the same.

In this case, if first heat sink 31 to which high beam light emitting device 11 is fixed and second heat sink 32 to which low beam light emitting device 14 were to shift out of alignment, desired light distribution patterns would not be achieved when the high beams and low beams were used.

In this case, if first heat sink 31 and second heat sink 32 were to shift horizontally (in the X axis direction), this would not affect the light distribution pattern, but if one or both of first heat sink 31 and second heat sink 32 were to rotationally shift in the XZ plane (horizontal plane) or rotationally shift about the Z axis, desired light distribution patterns would not be achieved. When this sort of rotational shift occurs, the low beam light distribution pattern in particular is greatly affected.

In light of this, lighting apparatus 1 includes a rotation restricting structure that restricts rotational movement of first heat sink 31 and second heat sink 32. In the fourth embodiment, the rotation restricting structure includes recessed portion 31*a* of first heat sink 31 and protruding portion 32*a* of second heat sink 32. Moreover, planar side surface 31*a*1 of recessed portion 31*a* and planar side surface 32*a*1 and protruding portion 32*a* are in contact.

With this, one or both of first heat sink 31 and second heat sink 32 can be restricted from rotating in the XZ plane (horizontal plane). This makes it possible to achieve both optical alignment and thermal efficiency.

Moreover, in the fourth embodiment, the heat sink is divided into two upper and lower portions (first heat sink 31 and second heat sink 32), and the portions of first heat sink 31 and second heat sink 32 that join together are planar surfaces (contact surfaces).

With this, one or both of first heat sink 31 and second heat sink 32 can be restricted from rotating about the Z axis.

Moreover, in the fourth embodiment, first heat sink 31 includes sloping surface 31*b* that slopes toward the front and second heat sink 32 includes sloping surface 32*b* that slopes toward the front. Moreover, recessed portion 31*a* of first heat sink 31 is formed at an end portion of the slope of sloping surface 31*b* of first heat sink 31, and protruding portion 32*a* of second heat sink 32 is formed at an end portion of the slope of sloping surface 32*b* of second heat sink 32.

With this, when sloping surface 31*b* and sloping surface 32*b* are placed in contact with each other upon assembling first heat sink 31 and second heat sink 32 together, the weight of first heat sink 31 causes first heat sink 31 to slide, making it easy to bring recessed portion 31*a* of first heat sink 31 and protruding portion 32*a* of second heat sink 32 into contact. This makes it easy to assemble first heat sink 31 and second heat sink 32 together while also aligning first heat sink 31 and second heat sink 32 in the Z axis direction.

Moreover, lighting apparatus 1 according to the fourth embodiment includes an anteroposterior movement restricting structure that restricts anteroposterior movement (movement along the Z axis) of first heat sink 31 and second heat sink 32. In the fourth embodiment, recessed portion 31*a* of first heat sink 31 and protruding portion 32*a* of second heat sink 32 restrict anteroposterior movement of first heat sink 31 and second heat sink 32. More specifically, one of recessed portion 31*a* of first heat sink 31 and protruding portion 32*a* of second heat sink 32 pushes against the other to restrict anteroposterior movement of first heat sink 31 and second heat sink 32.

As described above, lighting apparatus 1 and automobile 100 according to the fourth embodiment can achieve both optical alignment and thermal efficiency for two light emitting devices (high beam light emitting device 11 and low beam light emitting device 14) without compromising the ease of assembly of the lighting apparatus.

Summary of Fourth Embodiment

As described above, lighting apparatus 1 according to the fourth embodiment is for vehicle use, projects light forward, and includes: base 2 including heat sink 30; first light emitting device 11 disposed on base 2; second light emitting device 14 disposed on base 2; and lens body 20 disposed in front of first light emitting device 11 and second light emitting device 14, wherein heat sink 30 includes first heat sink 31 thermally coupled to first light emitting device 11 and second heat sink 32 thermally coupled to second light emitting device 14, and first heat sink 31 and second heat sink 32 are adjoined in a direction intersecting the anteroposterior direction.

Here, first light emitting device 11 may be fixed to first heat sink 31, and second light emitting device 14 may be fixed to second heat sink 32.

Here, lighting apparatus 1 may further include a rotation restricting structure that restricts rotational movement of first heat sink 31 and second heat sink 32.

Here, rotation restricting structure may include recessed portion 31*a* formed in first heat sink 31, in a portion facing second heat sink 32, and protruding portion 32*a* formed on second heat sink 32, on a portion facing first heat sink 31; recessed portion 31*a* may be formed so as to recede away from second heat sink 32 and include a planar side surface facing the anteroposterior direction; protruding portion 32*a* may be formed so as to protrude toward first heat sink 31 and include a planar side surface facing the anteroposterior direction; and the planar side surface of recessed portion 31*a* and the planar side surface of protruding portion 32*a* are in contact.

Here, first heat sink 31 and second heat sink 32 may each include a sloping surface, the sloping surface of first heat sink 31 and the sloping surface of second heat sink 32 may slope forward and be in contact, recessed portion 31*a* may be formed at an end portion of the sloping surface of first heat sink 31, and protruding portion 32*a* may be formed at an end portion of the sloping surface of second heat sink 32.

Here, the lighting apparatus may include an anteroposterior movement restricting structure that restricts anteroposterior movement of first heat sink 31 and second heat sink 32.

Here, anteroposterior movement restricting structure may include recessed portion 31*a* formed in first heat sink 31, in a portion facing second heat sink 32, and protruding portion 32*a* formed on second heat sink 32, on a portion facing first heat sink 31; recessed portion 31*a* may be formed so as to recede away from second heat sink 32 and include a planar side surface facing the anteroposterior direction; protruding portion 32*a* may be formed so as to protrude toward first heat sink 31 and include a planar side surface facing the anteroposterior direction; and the planar side surface of recessed portion 31*a* and the planar side surface of protruding portion 32*a* are in contact.

Here, first heat sink 31 and second heat sink 32 may each include a sloping surface, the sloping surface of first heat sink 31 and the sloping surface of second heat sink 32 may slope forward and be in contact, recessed portion 31*a* may be formed at an end portion of the sloping surface of first heat sink 31, and protruding portion 32*a* may be formed at an end portion of the sloping surface of second heat sink 32.

Here, one of first light emitting device 11 and second light emitting device 14 may be a high beam light source, and the remaining one of first light emitting device 11 and second light emitting device 14 may be a low beam light source.

Moreover, automobile 100 according to the fourth embodiment includes the above-described lighting apparatus 1, and vehicle body 110 including lighting apparatus 1 disposed in front.

Other Modified Embodiments

Although the lighting apparatus, automobile, etc., according to the present disclosure are described based on the first through fourth embodiments, the present disclosure is not limited to these embodiments.

Figure 31:
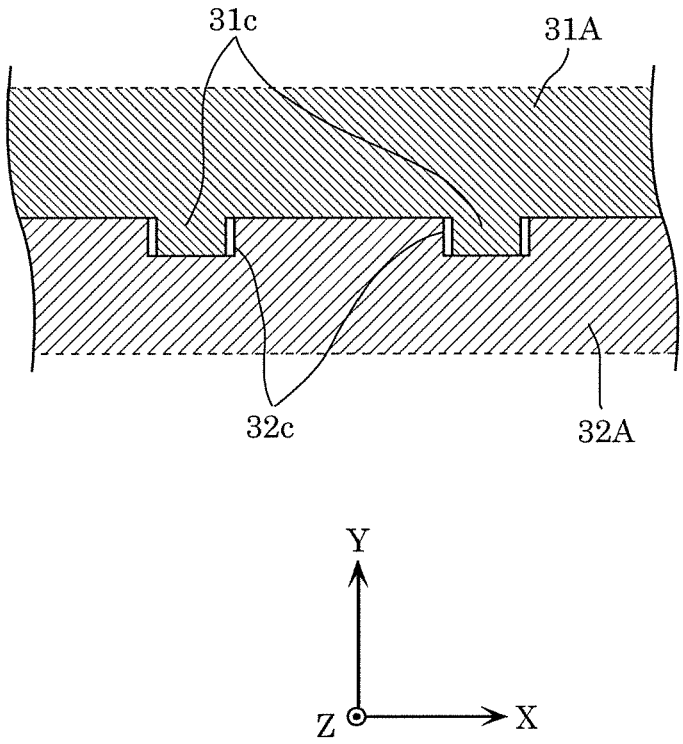
FIG. 31 is an enlarged view of a portion of a lighting apparatus according to one example of the present invention.

For example, in the above embodiments, the rotation restricting structure is exemplified as recessed portion 31*a* and protruding portion 32*a*, where planar side surface 31*a*1 of recessed portion 31*a* and planar side surface 32*a*1 of protruding portion 32*a* are brought into contact to restrict rotational movement of first heat sink 31 and second heat sink 32. However, the rotation restricting structure is not limited to this example; the rotation restricting structure may, for example, be configured as illustrated in FIG. 31. More specifically, first heat sink 31A may include two protruding portions 31*c* along the X axis, and second heat sink 31A may include two recessed portions 32*c* along the X axis. In this case, first heat sink 31A and second heat sink 32A are assembled by fitting the two protruding portions 31*c* and the two recessed portions 32*c* together.

Note that protruding portion 31*c* may have a circular or quadrilateral shape in a bottom view and recessed portion 32*c* may have a circular or quadrilateral shape in a top view, but by forming protruding portion 31*c* and recessed portion 32*c* to have a non-circular shape, such as a quadrilateral shape, in bottom and top views, respectively, only one protruding portion 31*c* and one recessed portion 32*c* need be formed. Moreover, in FIG. 31, protruding portions 31*c* are formed on first heat sink 31A and recessed portions 32*c* are formed on second heat sink 32A, but conversely the recessed portions may be formed on first heat sink 31A and the protruding portions may be formed on second heat sink 32A.

Moreover, in the above embodiments, recessed portion 31*a* is formed on first heat sink 31 and protruding portion 32*a* is formed on second heat sink 32, but conversely a protruding portion equivalent to protruding portion 32*a* may be formed on first heat sink 31 and a recessed portion equivalent to recessed portion 31*a* may be formed on second heat sink 32.

Moreover, in the above embodiments, heat sink 30 is divided into two components—and upper component and a lower component—but heat sink 30 is not limited to this configuration. For example, heat sink 30 may be divided into a left component and a right component, and first heat sink 31 and second heat sink 32 may be horizontally adjacent to each other. Moreover, heat sink 30 is not limited to two components; heat sink 30 may be divided into three or more components.

Moreover, in the above embodiments, the lighting apparatus is exemplified as being applied to a headlight that projects a high beam and a low beam, but the lighting apparatus may be applied to an auxiliary light such as a fog light or a daylight/daytime running light (DRL).

Moreover, although the automobile is exemplified as a four-wheeled automobile in the above embodiments, the automobile may be other automobiles such as a two-wheeled automobile (motorbike).

Moreover, in the above embodiments, the light emitting devices are exemplified as LEDs, but the light emitting devices may be semiconductor devices such as semiconductor lasers, electroluminescent (EL) devices such as organic EL devices or non-organic EL devices, or any other solid state light emitting device.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus for vehicle use that projects light forwardly, the lighting apparatus comprising:

a base including a heat sink, the heat sink comprising a first heat sink and a second heat sink;

a first light emitter disposed on the base;

a second light emitter disposed on the base;

a first lens body disposed in front of the first light emitter;

a second lens body disposed in front of the second light emitter;

a light restrictor adjacent to the first lens body, the light restrictor restricting light emitted by the second light emitter from entering the first lens body, and a rotation restrictor that restricts rotational movement of the first heat sink and the second heat sink, wherein the rotation restrictor includes: a recessed portion in the first heat sink, positioned facing the second heat sink; and a protruding portion on the second heat sink, positioned facing the first heat sink, the recessed portion recedes away from the second heat sink and includes a planar side surface facing an anteroposterior direction, the protruding portion protrudes toward the first heat sink and includes a planar side surface facing the anteroposterior direction, and the planar side surface of the recessed portion and the planar side surface of the protruding portion are in contact.

2. The lighting apparatus according to claim 1, wherein the base further includes a shield that defines a cut-off line for light emitted forward by the second light emitter wherein the light restrictor is an integrally fabricated portion of the shield.

3. The lighting apparatus according to claim 1, wherein the light restrictor is an integrally fabricated portion of the heat sink.

4. The lighting apparatus according to claim 1, wherein the base further includes a shield that defines a cut-off line for light emitted forward by the second light emitter wherein the light restrictor includes:

a first component integrally fabricated with the shield; and a second component integrally fabricated with the heat sink, and the first component and the second component at least partially overlap one another.

5. The lighting apparatus according to claim 1, further comprising a substrate on which the second light emitter is mounted, wherein the base includes:

a substrate retainer that restricts movement of the substrate in a direction perpendicular to a surface of the substrate; and a substrate stop that inhibits movement of the substrate in a direction parallel to the surface of the substrate.

6. The lighting apparatus according to claim 5, wherein the substrate is substantially rectangular and includes, in a corner, a recessed portion abutting the substrate stop.

7. The lighting apparatus according to claim 1, wherein one of the first light emitter and the second light emitter is a low beam light source for use in an automobile, and a remaining one of the first light emitter and the second light emitter is a high beam light source for use in the automobile.

8. The lighting apparatus according to claim 1, further comprising:

a first light source module disposed on the base; and a second light source module disposed on the base, wherein the first light source module includes a substrate and a plurality of the first light emitters mounted on the substrate, the second light source module includes the second light emitter, the first lens body includes a plurality of lenses disposed in front of the plurality of the first light emitters in a one-to-one relationship, the substrate is held down onto the base by a substrate retainer, and the substrate retainer is disposed in a position that does not overlap with the plurality of lenses in a front view of the lighting apparatus.

9. The lighting apparatus according to claim 8, wherein the substrate is held down onto the heat sink by the substrate retainer.

10. The lighting apparatus according to claim 9, wherein the first light source module is fixed to the first heat sink and the second light source module is fixed to the second heat sink, and the substrate is held down onto the first heat sink by the substrate retainer.

11. The lighting apparatus according to claim 8, wherein the first lens body includes a connecting portion that connects adjacent ones of the plurality of lenses, and the substrate retainer is disposed on the connecting portion and protrudes toward the substrate.

12. The lighting apparatus according to claim 11, wherein the connecting portion is a plate having a substantially arc-shaped outer edge in a front view of the lighting apparatus, and an outer perimeter of the plate in a front view of the lighting apparatus is defined by a portion of an outer edge of the adjacent ones of the plurality of lenses and the substantially arc-shaped outer edge.

13. The lighting apparatus according to claim 1, wherein, the first heat sink is thermally coupled to the first light emitter and the second heat sink is thermally coupled to the second light emitter, and the first heat sink and the second heat sink are adjoined in a direction intersecting the anteroposterior direction.

14. The lighting apparatus according to claim 13, wherein the first light emitter is fixed to the first heat sink, and the second light emitter is fixed to the second heat sink.

15. A lighting apparatus for vehicle use that projects light forward, the lighting apparatus comprising:

a base, the base including a heat sink a first light emitter disposed on the base;

a second light emitter disposed on the base;

a first lens body disposed in front of the first light emitter;

a second lens body disposed in front of the second light emitter;

a light restrictor adjacent to the first lens body, the light restrictor restricting light emitted by the second light emitter from entering the first lens body, the heat sink includes a first heat sink thermally coupled to the first light emitter and a second heat sink thermally coupled to the second light emitter, the first heat sink and the second heat sink are adjoined in a direction intersecting an anteroposterior direction, wherein the first light emitter is fixed to the first heat sink, and the second light emitter is fixed to the second heat sink; and a rotation restrictor that restricts rotational movement of the first heat sink and the second heat sink, wherein the rotation restrictor includes: a recessed portion in the first heat sink, in a portion facing the second heat sink; and a protruding portion on the second heat sink, on a portion facing the first heat sink, the recessed portion recedes away from the second heat sink and includes a planar side surface facing the anteroposterior direction, the protruding portion protrudes toward the first heat sink and includes a planar side surface facing the anteroposterior direction, and the planar side surface of the recessed portion and the planar side surface of the protruding portion are in contact.

16. The lighting apparatus according to claim 15, wherein the first heat sink and the second heat sink each include a sloping surface, the sloping surface of the first heat sink and the sloping surface of the second heat sink slope forward and are in contact, the recessed portion is at an end portion of the sloping surface of the first heat sink, and the protruding portion is at an end portion of the sloping surface of the second heat sink.

17. An automobile comprising the lighting apparatus according to claim 15.

* * * * *